US007932007B2

(12) United States Patent
Yamashita et al.

(10) Patent No.: US 7,932,007 B2
(45) Date of Patent: Apr. 26, 2011

(54) TONER AND METHOD FOR PRODUCING THE SAME, AND IMAGE-FORMING METHOD USING THE SAME

(75) Inventors: Hiroshi Yamashita, Numazu (JP); Chiaki Tanaka, Shizuoka (JP); Yohichiroh Watanabe, Fuji (JP); Tsunemi Sugiyama, Yokohama (JP); Masahiro Ohki, Numazu (JP); Sonoh Matsuoka, Numazu (JP); Masahide Yamada, Numazu (JP); Naohiro Watanabe, Shizuoka (JP); Akinori Saitoh, Numazu (JP); Ryota Inoue, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 497 days.

(21) Appl. No.: 11/229,748

(22) Filed: Sep. 20, 2005

(65) Prior Publication Data

US 2006/0068312 A1 Mar. 30, 2006

(30) Foreign Application Priority Data

Sep. 21, 2004 (JP) ..... 2004-273063

(51) Int. Cl.
*G03G 9/08* (2006.01)

(52) U.S. Cl. ..... 430/109.4; 430/111.4; 430/108.4

(58) Field of Classification Search ..... 430/109.4, 430/108.4, 111.4, 137.14
See application file for complete search history.

(56) References Cited

U.S. PATENT DOCUMENTS 3,910,846 A * 10/1975 Azar et al. ..... 430/137.11
6,787,280 B2 9/2004 Yamashita et al.
6,846,604 B2 1/2005 Emoto et al.
6,849,369 B2 2/2005 Yagi et al.
6,852,462 B2 2/2005 Emoto et al.
6,936,390 B2 8/2005 Nanya et al.
2003/0138717 A1 7/2003 Yagi et al.
2004/0115551 A1 6/2004 Sugiyama et al.
2004/0121256 A1 6/2004 Suzuki et al.
2004/0131961 A1 7/2004 Watanabe et al.
2004/0142264 A1* 7/2004 Tanaka et al. ..... 430/108.4
2004/0157146 A1 8/2004 Tomita et al.
2004/0185365 A1 9/2004 Saito et al.
2005/0003291 A1 1/2005 Takada et al.

(Continued)

FOREIGN PATENT DOCUMENTS

JP 10-207116 8/1998

(Continued)

OTHER PUBLICATIONS

Aoki, Takayoshi. "Chemical Toner Technology and the Future" IS&T's NIP19. Springfield, Virginia: Society for Imaging Science and Technology. pp. 2-4.*

(Continued)

*Primary Examiner* — Christopher RoDee
(74) *Attorney, Agent, or Firm* — Oblon, Spivak, McClelland, Maier & Neustadt, L.L.P.

(57) ABSTRACT

There are provided: a method for producing a toner containing to granulate a toner and to subjecting the granulated toner to at least washing with an alkali washing solution, in which the total organic carbon amount extractable from the alkali-washed toner is 200 ppm/g or less; a toner comprising polyester in which the total organic carbon amount extractable from the toner is 200 ppm/g or less, under the condition that the toner is subjected to washing with the alkali washing solution before extracting; and an image-forming method using such a toner.

7 Claims, 5 Drawing Sheets

U.S. PATENT DOCUMENTS

| | | | |
|---|---|---|---|
| 2005/0026066 | A1 | 2/2005 | Tanaka et al. |
| 2005/0042534 | A1 | 2/2005 | Tanaka et al. |
| 2005/0164112 | A1 | 7/2005 | Ohki et al. |
| 2005/0196691 | A1 | 9/2005 | Ohtani et al. |

FOREIGN PATENT DOCUMENTS

| | | | |
|---|---|---|---|
| JP | 10-319624 | | 12/1998 |
| JP | 2001-175028 | | 6/2001 |
| JP | 2002-296839 | | 10/2002 |
| JP | 2003-140381 | | 5/2003 |
| JP | 2004-109768 | | 4/2004 |
| JP | 2004-206081 | | 7/2004 |
| JP | 2005-015589 | | 1/2005 |
| JP | 2005106892 | A * | 4/2005 |

OTHER PUBLICATIONS

U.S. Appl. No. 11/487,374, filed Jul. 17, 2006, Yamashita, et al.
U.S. Appl. No. 11/513,175, filed Aug. 31, 2006, Ohki, et al.
U.S. Appl. No. 11/676,883, filed Feb. 20, 2007, Tanaka.
U.S. Appl. No. 11/687,075, filed Mar. 16, 2007, Yamada, et al.
U.S. Appl. No. 11/685,872, filed Mar. 14, 2007, Uchinokura, et al.
U.S. Appl. No. 11/687,372, filed Mar. 16, 2007, Yamada, et al.
U.S. Appl. No. 11/520,642, filed Sep. 14, 2006, Chiaki Tanaka, et al.
U.S. Appl. No. 11/519,893, filed Sep. 13, 2006, Ryota Inoue, et al.
U.S. Appl. No. 11/685,969, filed Mar. 14, 2007, Uchinokura, et al.
U.S. Appl. No. 11/738,149, filed Apr. 20, 2007, Iwamoto, et al.
U.S. Appl. No. 11/755,484, filed May 30, 2007, Watanabe, et al.
U.S. Appl. No. 11/755,517, filed May 30, 2007, Iwamoto, et al.
U.S. Appl. No. 11/868,618, filed Oct. 8, 2007, Sugiyama, et al.
U.S. Appl. No. 11/851,475, filed Sep. 7, 2007, Watanabe, et al.
U.S. Appl. No. 11/852,778, filed Sep. 10, 2007, Nagatomo, et al.
U.S. Appl. No. 11/854,842, filed Sep. 13, 2007, Sugimoto, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 11/857,999, filed Sep. 19, 2007, Yamashita, et al.
U.S. Appl. No. 12/026,937, filed Feb. 6, 2008, Seshita, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/049,686, filed Mar. 17, 2008, Kotsugai, et al.
U.S. Appl. No. 12/203,278, filed Sep. 3, 2008, Yamada, et al.
U.S. Appl. No. 10/645,804, filed Aug. 22, 2003, Masami Tomita, et al.

* cited by examiner

TONER AND METHOD FOR PRODUCING THE SAME, AND IMAGE-FORMING METHOD USING THE SAME

BACKGROUND OF THE INVENTION

1. Field of the Invention

The present invention relates to a toner which is suitably applicable for an electrophotography, a latent electrostatic recording method, a latent electrostatic printing method and the like. The present invention also relates to an efficient method for producing such a toner. Moreover, the present invention is directed to a developer, a toner container, a process cartridge, an image-forming apparatus, and an image-forming method, all of which employ the aforementioned toner.

2. Description of the Related Art

Dry toners have been conventionally applied in electrophotography, latent electrostatic recording methods, latent electrostatic printing methods, and the like. The dry toners in use are generally obtained by kneading a toner binder such as styrene resin, acrylic resin, polyester resin or the like together with other component such as a colorant, and crushing the mixture.

The conventional dry toners, however, cannot sufficiently satisfy the recent demands such as of high quality, formation of high quality image, and low-temperature fixing properties. Specifically, the dry toners which are crushed and classified have limits in miniaturization of the toner, or crushing yields. Therefore, there is a problem such that a toner having small particle size and sharp particle size distribution, and is capable of forming high quality images cannot be efficiently produced.

To overcome such problems, intensive studies and improvements have been made on chemically prepared toners (CP toners). As a chemically prepared toner, there have been proposed: a polymerization toner which is formed using vinyl monomer or the like in accordance with suspension-polymerization method, emulsification-polymerization-aggregation method, seed-polymerization method, dispersion-polymerization method or the like; and an elongation toner which is formed by subjecting polyester prepolymer an elongation reaction (referred to Japanese Patent Application Laid-Open (JP-A) No. 2002-296839). Among the chemical toners proposed, the elongation toner is most recognized because of use of polyester resin which is advantageous for realizing low-temperature fixing.

However, such an elongation toner has the following drawbacks.

In the process of producing the elongation toner, an oil phase, which prepared by dissolving and/or dispersing toner materials such as polyester prepolymer, a releasing agent, a colorant and the like in an organic solvent, is dispersed in water together with a surfactant and resin particles. Therefore, the obtained toner particles have the resin particles on the surface of the toner particles. Moreover, onto the surface of the toner particles or resin particles, the surfactant, ionic impurities, and the like may be attached. These attachments are liable to decrease charging ability, and thus adversely affect on a resistance of the toner to the environmental changes. To prevent the toner from decreasing its charge ability, it is necessary to wash the toner particles and to remove the attachments therefrom.

As a washing method of the toner, there is proposed a method in which, for example, an emulsification-aggregation toner is sequentially washed with alkaline solution, acidic solution, and water (JP-A No. 2001-175028).

When this washing method is applied to the elongation toner, the ionic impurities or surfactant may be merely removed from the toner particles, but the charging ability is not sufficiently maintained.

As described above, the current situations are such that there have not yet provided a toner having excellent charging ability, shelf stability, low-temperature fixing properties and high quality image formation, a method for producing such a toner, and relative technologies utilizing such a toner.

It is therefore an object of the present invention is to provide a toner and an efficient method for producing the toner which has excellent cleaning ability, shelf stability and low-temperature fixing properties, and attains high quality images. It is another object of the present invention is to provide an image-forming method using the toner formed by the method of the present invention.

SUMMARY OF THE INVENTION

The inventors of the present invention has diligently studied to accomplish the aforementioned objects and found that a toner has an excellent charging ability, excellent shelf stability, and excellent low-temperature fixing properties as well as attaining high quality image, when a total organic carbon amount extractable from an alkali-washed toner is 200 ppm/g or less.

The present invention has also found that an excellent charging ability can be attained by controlling the conditions, such as pH, temperature, time-period, and the like of washing with an alkali washing solution.

The toner of the present invention comprises polyester, wherein a total organic carbon amount extractable from the toner is 200 ppm/g or less after a final alkali washing, under the condition that the toner is subjected to washing with a neutral washing solution and at least one alkali washing solution before extracting the organic carbon, and wherein TOC neutral amount <TOC alkali amount. In the alkali washing, emulsifiers, dispersants, ionic impurities and the like are removed from the surface of the toner particles. As mentioned above, the total organic carbon amount extractable from the alkali-washed toner is maintained at a certain level or lower. Although it has conventionally been known that, if polyester having a high acid value is used on the purpose of improving pigment-dispersibility, fixing properties, charging ability, and the like, there is remained a large amount of acid monomers without being reacted. In the present invention, such remained acid monomers can be removed. As a result, the toner of the invention has an excellent charging ability, desirable shelf stability and excellent fixing properties, and attains high quality images.

Resin particles attached to the surface of the toner are generally considered to be a factor to cause a charging inferior, or fixing inferior under high humidity environment, since the resin particles have a large number of acid groups. In the present invention, however, the resin particles are removed by the alkali washing at an appropriate amount so that the sufficient charging ability is maintained even if the toner of the present invention comprises the resin particles. When the toner comprises particles containing an adhesive-base material formed by reacting an active hydrogen-group containing compound and polymer capable of reacting with an active hydrogen-group containing compound, moreover, the toner excels in various properties such as aggregation resistance, charging ability, flowability, transfer properties, fixing properties and the like. When such a toner is used for forming an image, high quality images are obtained under the conditions of low-temperature fixing.

The preferable embodiments of the toner of the present invention are: an embodiment in which the resin particles are formed of at least one resin selected from the group consisting of vinyl resin, polyurethane resin, epoxy resin, and polyester resin; an embodiment in which the polyester has an acid value of 5 mg KOH/g to 50 mg KOH/g; an embodiment in which the alkali washing solution has pH of 6.0 to 11.0 after washing the granulated toner therein; and an embodiment in which water containing the toner therein has a conductivity of 0.5 μS/cm to 60.0 μS/cm, when the toner is subjected to the alkali washing, a solid-liquid separation, and washing with the water.

The method for producing a toner of the present invention comprises: granulating a toner; and subjecting the granulated the toner to at least washing with an alkali washing solution, wherein a total organic carbon amount extractable from the alkali-washed toner is 200 ppm/g or less. Note that, when washing with the alkali washing solution (alkali washing) is performed more than once, the total organic carbon amount of 200 ppm/g or less is extractable at least from the toner after being subjected to the final alkali washing.

In the present invention, the toner comprising the polyester is granulated at the time of the granulating. The granulated toner is subjected to at least washing with an alkali washing solution so that a total organic carbon amount extractable from the alkali-washed toner becomes 200 ppm/g or less. In the alkali washing, emulsifiers, dispersants, ionic impurities and the like are removed from the surface of the toner particles. Although it has conventionally been known that, if the polyester having high acid value is used on the purpose of improving pigment-dispersibility, fixing properties, charging ability, and the like, there is remained a large amount of acid monomers without being reacted. In the present invention, such remained acid monomers can be removed. As a result, the toner produced by the invention has an excellent charging ability, desirable shelf stability and excellent fixing properties, and attains high quality images.

The resin particles attached to the surface of the toner are generally considered to be a factor to cause a charging inferior, or fixing inferior under high humidity environment, since the resin particles have a large number of acid groups. In the present invention, however, the resin particles are removed by the alkali washing at an appropriate amount so that the sufficient charging ability is maintained. Therefore, there is efficiently produced a toner having an excellent charging ability, desirable shelf stability and excellent fixing properties, and attaining high quality images. When the granulating is to emulsify and/or disperse, in an aqueous medium, an active hydrogen-group containing compound and polymer capable of reacting with an active hydrogen-group containing compound to react, thereby forming particles containing an adhesive-base material, there can be efficiently produce a toner which is excels in various properties such as aggregation resistance, charging ability, flowability, transfer properties, fixing properties and the like.

The preferable embodiments of the method for producing a toner of the present invention are: an embodiment in which the alkali washing solution has pH of 6.0 to 11.0 after washing the granulated toner therein; an embodiment further comprising subjecting the alkali washed toner to a solid-liquid separation and subjecting the separated toner to washing with water, wherein the water has a conductivity of 0.5 μS/cm to 60.0 μS/cm after washing; an embodiment in which a temperature of the alkali washing solution is 10° C. to 70° C. at the time of washing; an embodiment in which the relationship of $(Tg-10) \leqq T \leqq (Tg+10)$ is satisfied in which T denotes a temperature at the time of washing with the alkali washing solution, and Tg denotes a glass transition temperature of the granulated toner; and an embodiment in which a time-period for the washing with the alkali washing solution is 1 hour to 72 hours.

The toner of the present invention can be contained in a developer. When image formation is performed by using such a developer, there can be formed high quality images with high image density and high resolution.

The toner of the present invention can be commercialized as a toner container in which the toner of the present invention is loaded. When image formation is performed by using the toner of the present invention loaded in the toner container, there can be formed high quality images with high image density and high resolution.

The toner of the present invention can be loaded in a process cartridge. Such a process cartridge comprises a latent electrostatic image bearing member and a developing unit which develop a latent electrostatic image formed on the latent electrostatic image bearing member with the toner of the present invention so as to form a visible image. This process cartridge is detachable to an image-forming apparatus and excels in easy handling or convenience. Since the process cartridge comprises the toner of the present invention, the process cartridge is capable of forming high quality images with high image density and high resolution.

The toner of the present invention can be loaded in an image-forming apparatus. Such an image-forming apparatus comprises a latent electrostatic image bearing member, a latent electrostatic image forming unit which configured to form a latent electrostatic image on the latent electrostatic image bearing member, a developing unit which is configured to develop the latent electrostatic image with the toner of the present invention so as to form a visible image, a transferring unit which is configured to transfer the visible image to a recording medium, and a fixing unit which is configured to fix the transferred image onto the recording medium. In course of image formation by means of the image-forming apparatus, the latent electrostatic image is developed with the toner of the present invention by the developing unit, the visible image is transferred to a recording medium by the transferring unit, and the transferred image is fixed onto the recording medium by the fixing unit. As a result, there are formed high quality images with high image density and high resolution.

The image-forming method of the present invention comprising: forming a latent electrostatic image on a latent electrostatic image bearing member; developing the latent electrostatic image bearing member with the toner of the present invention so as to make the latent electrostatic image visible; transferring the visible image to a recording medium; and fixing the transferred image onto the recording medium. In the image-forming method of the present invention, a latent electrostatic image is formed on a latent electrostatic image bearing member, the latent electrostatic image is developed with the toner of the present invention so as to make the latent electrostatic image visible, the visible image is transferred to a recording medium, and the transferred image is fixed onto the recording medium. As a result, a high quality image with high image density and high resolution is formed under the conditions for low-temperature fixing.

DESCRIPTION OF THE PREFERRED EMBODIMENTS (Toner)

Figure 1:
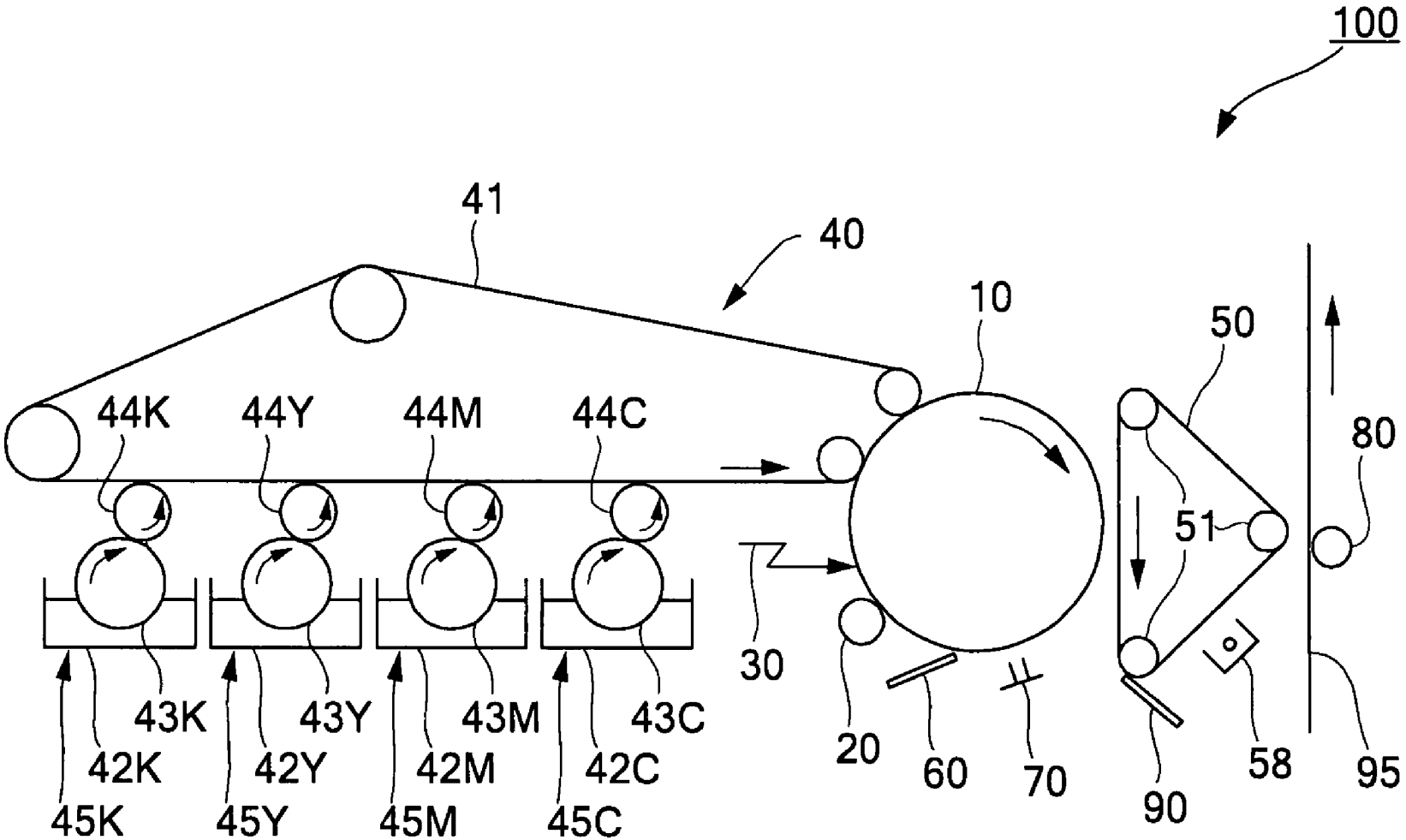
FIG. 1 is a schematic diagram to show an exemplary embodiment of an image-forming method according to the present invention with assistance of an image-forming apparatus.

The toner of the present invention comprises polyester, wherein a toner organic carbon amount extractable from the toner is 200 ppm/g or less, under the condition that the toner is subjected to washing with an alkali washing solution before extracting the organic carbon. The toner of the present invention preferably comprises resin particles and crystalline polyester, and further comprises other components such as a colorant, a releasing agent, a charge controlling agent, and the like, if necessary.

Note that "ppm/g" denotes an amount of carbon in organic substances extracted from 1 g of a dry toner.

The toner of the present invention is not particularly limited, and can be appropriately selected in accordance with a purpose. A suitably example thereof is a chemical toner comprising a binder resin, which is produced by the conventional suspension-polymerization method, emulsification-polymerization method, dissolution-suspension method or the like. More preferably example is a toner which is formed of particles comprising an adhesive-base material formed by reacting an active hydrogen group-containing compound with polymer capable of reacting with an active hydrogen group-containing compound.

In the present invention, it is preferred that toner releases less the total organic carbon amount as extraction. It is 200 ppm/g or less, preferably 150 ppm/g or less, and more preferably 100 ppm/g or less. In the case that the extractable TOC amount is more than 200 ppm/g, the charging ability may be degraded, especially under high temperature and/or high humidity environment.

The analysis method of the extractable total organic carbon (TOC) amount is performed, for example, by measuring the extractable carbon amount from the alkali-washed toner by means of TOC analyzer, TOC-5000A, manufactured by Shimadzu Corporation, in the following manner:

(1) In the case that a sample is wet-cake or dispersion, a solid content (% by mass) of the sample is measured first. When the sample is a solid toner, a solid content thereof is 100% by mass.
(2) 7.5 g of the sample (wet-cake, dispersion, toner, etc.) is precisely weighted in a 140 ml bottle (S1).
(3) To the bottle of (2) is added 47.5 g of KOH aqueous solution exhibiting pH 9.
(4) Ultrasonic is imparted to the mixture at 30° C. or lower for 30 minutes.
(5) About 1.5 ml of the mixture is subjected to centrifugal separation in a microtube.
(6) Supernatant of the separated mixture is filtered by 0.2 μm microfilter so as to remove fine particles, and the rest of the supernatant is poured back to the microtube.
(7) The filter is washed by tap-water and then by pure water, and then the depositions of the separated mixture obtained in (5) are filtered by 1 μm microfilter.
(8) To the filtrate obtained in (7) is added two drops of HCl (35% by mass) aqueous solution, and pH of the mixed solution is confirmed to be 3 or less.
(9) The mixed solution obtained in (8) is precisely weighted (T1).
(10) The mixed solution obtained in (8) is added and diluted with pure water so that the total weight to be 6.0 mg, and then is precisely weighted (T2).
(11) The thus obtained solution is heated or combusted at a high temperature so as to generate the carbon in the organic substances in the solution as carbonic acid gas, and the extracted TOC amount is measured by analyzing the carbonic acid gas by infrared spectroscopy.
(12) The TOC amount can be calculated by the following equation. TOC (ppm/g)=TOC measurement×(S1+S2)/{S1×(Solid content (mass %)/100)}×T2/T1)

The pH of the alkali washing solution after washing the toner therein is 6.0 to 11.0, and preferably 8.0 to 10.0. In the case that pH is less than 6.0, the improved charging ability or shelf stability by the alkali washing cannot be attained. In the case that pH is more than 11.0, the polyester is liable to induce hydrolysis reaction which is not preferable.

The conductivity of the water is 0.5 μS/cm to 60 μS/cm, and preferably 2 μS/cm to 20 μS/cm, after alkali washing, solid-liquid separating and water washing the toner. In the case that the conductivity is less than 0.5 μS/cm, or more than 60 μS/cm, the charging ability may not be improved.

In order to maintain the conductivity within the aforementioned range, anionic impurities attached on the surface of the toner or resin particles should be removed. It is preferred that water washing is performed sequential to the alkali washing so as to prevent the anionic impurities from reattaching to the toner or the resin particles.

In the toner of the invention, the polyester has carboxyl group at a terminal thereof. It is preferred that a hydrogen atom of the carboxyl group is substituted by a sodium atom. In the process of the alkali washing, a hydrogen atom within the terminal carboxyl group of the polyester is substituted by a sodium atom to form a terminal group —COONa, and thus there is obtained a toner having an excellent charging ability and excellent charge-rising ability.

The method of the alkali washing is not particularly limited, and can be appropriately selected from the conventional washing methods in accordance with a purpose, under the condition that emulsifiers, dispersants, ionic impurities and the like are removed from the surface of the toner or the resin particles. Examples thereof are a washing with an aqueous solution of alkali metal salts and the like. The conditions of the alkali washing, e.g. a temperature, time, or the like are explained in the descriptions of the method for producing a toner of the present invention below.

—Polyester Resin—

The acid value of the polyester resin is not particularly limited, and can be appropriately adjusted in accordance with a purpose. It is preferably from 5 mg KOH/g to 50 mg KOH/g, and more preferably 20 mg KOH/g to 30 mg KOH/g. The use of the polymer resin having relatively high acid value is preferable in view of improved pigment-dispersibility, fixing properties and charging ability of the toner. The polyester resin of high acid value may generates a large amount of residual acid monomer on the surface of the toner particles, but such residual acid monomers can be removed by the alkali washing.

—Resin Particles—

The resin particles are used in the purpose of controlling the shape (circularity, particle size distribution, and the like) of the toner.

The resin particles contain a large number of acid groups. If the resin particles are located on the surface of the toner particles, it may lead charging disorder, fixing disorder or the like. However, such acid groups are appropriately removed by the alkali washing, while maintaining the charging ability.

The glass transition temperature (Tg) of the resin particles are not particularly limited, and can be appropriately adjusted in accordance with a purpose. When one or more types of resin particles are used, at least one glass transition temperature (Tg) of the resin particles is 20° C. to 100° C. In the case that the glass transition temperature (Tg) is lower than 20° C., the heat-resistance preservation is liable to degrade. In the case that the glass transition temperature (Tg) is higher than 100° C., on the other hand, the low-temperature fixing properties are liable to degrade.

The glass transition temperature is measured, for example, by means of TG-DSC/TAS-100 system (manufactured by Rigaku Corp.). A specific method is explained hereinafter.

About 10 mg of a toner sample is charged in a sample container formed of aluminum; the sample container is placed on a holder unit; the holder unit is set in an electric oven. The temperature therein is increased from an ambient temperature to 120° C. at 10° C./min.; the temperature is kept at 120° C. for 10 minutes; the sample toner is then cooled down to an ambient temperature and left to stand for 10 minutes. The sample toner is then heated up to 120° C. at 10° C./min under $N_2$ atmosphere; a DSC spectrum of the sample toner is measured by a differential scanning calorimeter. The glass transition temperature is calculated, by means of TG-DSC/TAS-100 system, based on a contact point of a tangent line of the endothermic carve nearby a glass transition temperature and a base line.

The mass average molecular mass (Mw) of the resin particles is 8,000 to 200,000, and preferably 10,000 to 100,000, in terms of a molecular mass distribution of a tetrahydrofuran (THF) soluble part measured by means of gel permeation chromatography (GPC).

In the case that the mass average molecular mass (Mw) is less than 8,000, it is liable to degrade heat resistance preservation. In the case that mass average molecular mass (Mw) is more than 200,000, it is liable to degrade low-temperature fixing properties.

The measurement of molecular mass distribution by means of the gel permeation chromatography (GPC) can be carried out by the following manner.

At first, a column is set and secured in a heat chamber at the interior temperature of 40° C. While maintaining the same interior temperature, tetrahydrofuran (THF) as a column solvent is flown into the column at the flow velocity of 1 ml/min. To this flow, there is introduced 50 μl to 200 μl of a tetrahydrofuran solution of a resin sample wherein the resin sample concentration is adjusted to 0.05% by mass to 0.6% by mass. The resin sample is then measured. In the measurement, the molecular mass distribution of the resin sample is calculated from the relationship between the logarithm values of calibration carve prepared from plurality of singly dispersed standard-polystyrene samples, and the counting number. The standard-polyester samples for calibration are, for example, standard polyester samples each respectively having a molecular mass of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, all of which are commercially available from Pressure Chemical Co. or Toyo Soda Co. Ltd., and are preferably about 10 standard polyester samples. Note that a refractive index (RI) detector can be used as a detector in the above measurements.

The resin particle content (residual amount) in the toner is not particularly limited, and can be appropriately adjusted in accordance with a purpose. It is preferably 0.5% by mass to 5.0% by mass, and more preferably 1.0% by mass to 3.0% by mass. In the case that the resin particle content is less than 0.5% by mass, the shelf stability of the toner is liable to degrade. In the case that the resin particle content is more than 5.0% by mass, the resin particles inhibit the wax ooze, and thus it may not be obtained a sufficient releasing ability. This lack of releasing ability is liable to cause offset.

The resin particle content (residual amount) in the toner can be measured by various methods. For example, a substance or functional group existed only in the resin particle is analyzed by means of Prolysis-Gas chromatography-Mass spectrometry (PY-GC/MS). The content is calculated from the peak area obtained by the analysis. A device for use in PY-GC/MS is, but limited to, a mass analyzer.

The resin particles are not particularly limited, under the condition that the resin particles are capable of forming aqueous dispersion by being added to the aqueous medium phase, and the material thereof can be appropriately selected from the conventional resins in accordance with a purpose. The resin particles may be formed of thermoplastic resin or thermosetting resin.

Examples of the material of the resin particles are vinyl resin, polyurethane resin, epoxy resin, polyester resin, polyamide resin, polyimide resin, silicone resin, phenol resin, melamine resin, ure resin, anilline resin, ionomer resin, polycarbonate resin, and the like. These may be selected singly or in combination of two or more, for use as the fine resin particles. Among these examples, the resin particles are preferably formed of one selected from the vinyl resin, polyurethane resin, epoxy resin, and polyester resin in view of an easy formation of aqueous dispersion of fine and spherical resin particles.

The vinyl resin is a polymer in which vinyl monomer is mono- or co-polymerized. Examples of the vinyl resin are styrene-(meth)acrylic ester resin, styrene-butadienel copolymer, (metha)acrylic acid-acrylic ester copolymer, sthrene-acrylonitrile copolymer, styrene-maleic anhydride copolymer, styrene-(metha)acrylic acid copolymer, and the like.

Moreover, the resin particles may be formed of copolymer containing a monomer having two or more unsaturated groups. The monomer having two or more unsaturated groups is not particularly limited, and can be selected in accordance with a purpose. Examples of such a monomer are sodium salt of sulfuric acid ester of ethylene oxide adduct of methacrylic acid (Eleminol RS-30, by Sanyo Chemical Industries Co.), divinylbenzene, hexane-1,6-diol acrylate, and the like.

The resin particles are formed by polymerizing the above-listed monomers in accordance with a method appropriately selected from conventional methods. The fine resin particles are preferably obtained in the form of aqueous dispersion of the resin particles. Examples of preparation method of such an aqueous dispersion are the following (1)-(8):

(1) a preparation method of aqueous dispersion of the resin particles, in which, in the case of the vinyl resin, a vinyl monomer as a starting material is polymerized by suspension-polymerization method, emulsification-polymerization method, seed polymerization method or dispersion-polymerization method;

(2) a preparation method of aqueous dispersion of the resin particles, in which, in the case of the polyaddition and/or condensation resin such as the polyester resin, the polyurethane resin, or the epoxy resin, a precursor (monomer, oligomer or the like) or solvent solution thereof is dispersed in an aqueous medium in the presence of an appropriate dispersing agent, and sequentially is heated or added with a curing agent so as to be cured, thereby obtaining the aqueous dispersion of the resin particles;

(3) a preparation method of aqueous dispersion of the resin particles, in which, in the case of the polyaddition and/or condensation resin such as the polyester resin, the polyurethane resin, or the epoxy resin, an arbitrary selected emulsifier is dissolved in a precursor (monomer, oligomer or the like) or solvent solution thereof (preferably being liquid, or being liquidized by heating), and then water is added thereto so that a phase inversion emulsification is induced, thereby obtaining the aqueous dispersion of the resin particles;

(4) a preparation method of aqueous dispersion of the fine resin particles, in which a previously prepared resin by a polymerization method, which is any of addition polymerization, ring-opening polymerization, polyaddition, addition condensation or condensation polymerization, is pulverized by means of a pulverizing mill such as mechanical rotation-type, jet-type or the like, the thus obtained resin powder is classified to thereby obtain resin particles, and then the resin particles are dispersed in an aqueous medium in the presence of an arbitrary selected dispersing agent, thereby obtaining the aqueous dispersion of the resin particles;

(5) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is sprayed in the form of mist to thereby obtain resin particles, and then the thus obtained resin particles are dispersed in an aqueous medium in the presence of an arbitrary selected dispersing agent, thereby obtaining the aqueous dispersion of the resin particles;

(6) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is subjected to precipitation by adding a poor solvent thereto or cooling after heating and dissolving, the solvent is sequentially removed to thereby obtain resin particles, and then the thus obtained fine resin particles are dispersed in an aqueous medium in the presence of an arbitrary selected dispersing agent, thereby obtaining the aqueous dispersion of the resin particles;

(7) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the resin particles;

(8) a preparation method of aqueous dispersion of the resin particles, in which a previously prepared resin by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so that phase inversion emulsification is induced, thereby obtaining the aqueous dispersion of the resin particles.

—Crystalline Polyester—

The crystalline polyester has crystallinity, and exhibits thermofusion properties which significantly decrease the viscosity thereof at approximately the fixing-starting temperature. In another word, the crystalline polyester has excellent heat resistance preservation due to crystallinity thereof below the fixing-starting temperature, and significantly decreases the velocity thereof (exhibits sharp-melt properties) at the fixing-starting temperature so as to contribute to the fixing of the toner. Accordingly, there can be realized a toner exhibiting both excellent heat resistance preservation and excellent low-temperature fixing properties. Moreover, the toner containing the crystalline polyester is also excellent in releasing properties margin (margin between the lowest fixing temperature and offset-occurring temperature).

The crystalline polyester is not particularly limited, and can be appropriately selected in accordance with a purpose. Suitable example of the crystalline polyester is crystalline polyester expressed by the following formula (1), which is synthesized by a diol compound having 2-6 carbon atoms as an alcohol component, and an acid component. It is preferred that the diol component contains 80% by mole or more, and more preferably 85% by mole to 100% by mole of butane-1, 4-diol, hexane-1,6-diol, and a derivative thereof, and the acid component is such as maleic acid, fumaric acid, succinic acid, and a derivative thereof.

Formula (1)

$$[-O-CO-(CR^1=CR^2)_L-CO-O-(CH_2)_n-]_m$$

In the above Formula (1), "n" and "m" denote a number of repeating unit, "L" denotes integer of 1-3, and "R1" and "R2", which are mutually identical or different, denote hydrogen atom or hydrocarbon group.

For the purpose of controlling the crystallinity and melting point of the crystalline polyester, the crystalline polyester is configured to have a non-linear polymeric structure, which is obtainable by adding trivalent or more polyhydric alcohol such as glycerin to the aforementioned alcohol component and/or adding trivalent or more polyvalent carboxylic acid such as trimellitic anhydride to the aforementioned acid component in course of condensation polymerization of the alcohol component and the acid component to synthesize the crystalline polyester. Note that, the polymeric structure of the crystalline polyester can be conformed in accordance with solid-state nuclear magnetic resonance (NMR) spectroscopy.

The mass average molecular mass (Mw) of the crystalline polyester is 1,000 to 30,000, and preferably 1,000 to 6,500 in terms of a molecular mass distribution of an o-dichlorobenzene soluble part measured by means of gel permeation chromatography (GPC). In the case that the mass average molecular mass (Mw) is less than 1,000, it is liable to degrade heat resistance preservation. In the case that the mass average molecular mass (Mw) is more than 30,000, it is liable to degrade low-temperature fixing properties.

The number average molecular mass (Mn) of the crystalline polyester is 500 to 6,000, and preferably 500 to 2,000 in terms of a molecular mass distribution of an o-dichlorobenzene soluble part measured by means of gel permeation chromatography (GPC).

The ratio (Mw/Mn) of the mass average molecular mass to the number average molecular mass is 2 to 8, and preferably 2 to 5. In a graph of the aforementioned molecular mass distribution by means of GPC, it is preferable to have a peak raining from 3.5 to 4.0, and peak width of 1.5 or less. Note that, the graph is to be drafted so that axis of abscissas indicates log (M), and axis of ordinate indicates % by mass.

The melting temperature and $F_{1/2}$ temperature of the crystalline polyester is preferably low, provided that heat resistance preservation is not degraded. For example, endothermic peak temperature of DSC is 50° C. to 150° C. In the case that the melting temperature and the $F_{1/2}$ temperature are lower than 50° C., heat resistance preservation is degraded, and thus it is liable to cause blocking at the interior temperature of the developing unit. In the case that the melting temperature and the $F_{1/2}$ temperature are higher than 150° C., lowest fixing temperature becomes rather high, and thus it is liable to degrade low-temperature fixing properties.

The molecular structure of the crystalline polyester is confirmed by Liquid or Solid State NMR, X-ray Diffraction, GC/MS, LC/MS, IR spectroscopy and the like. Among these, IR spectroscopy is preferable in view of ease of measurements.

The infrared spectrograph of the crystalline polyester preferably has an absorption band based on δ CH (out-of-plane deformation vibration) of olefin at 965±10 $cm^{-1}$ and/or 990±10 $cm^{-1}$. In the case that the absorption band The infrared spectrograph of the crystalline polyester preferably has an absorption band based on δ CH (out-of-plane deformation vibration) of olefin based on the δ CH of olefin is in the aforementioned ranges, low-temperature fixing properties are improved.

For the purpose of realizing low-temperature fixing properties in view of compatibility of a paper and the resin, the acid value of the crystalline polyester is preferably 8 mg KOH/g or more, and more preferably 20 mg KOH/g or more. In order to improve hot-offset properties, on the other hand, the acid value of the crystalline polyester is preferably 45 mg KOH/g or less.

The hydroxyl value of the crystalline polyester is preferably 0 to 50 mg KOH/g, and more preferably 5 mg KOH/g to 50 mg KOH/g in view of improvements in low-temperature fixing properties and a charging ability.

—Adhesive-Base Material—

The adhesive-base material exhibits adhesion to a recording medium such as a paper, and comprises an adhesive polymer resulted from a reaction, in an aqueous medium, of the active hydrogen group-containing compound and a polymer capable of reacting the active hydrogen group-containing compound. The adhesive-base material may further comprise a binder resin appropriately selected from the conventional binder resins.

A mass average molecular mass of the adhesive-base material is not particularly limited and can be appropriately adjusted in accordance with a purpose. It is 1,000 or more, preferably 2,000 to 10,000,000, and more preferably 3,000 to 1,000,000.

In the case that the mass average molecular mass of the adhesive-base material is less than 1,000, the offset resistance may be degraded.

A glass transition temperature (Tg) of the adhesive-base material is not particularly limited and can be appropriately adjusted in accordance with a purpose. It is 30° C. to 70° C., and preferably 40° C. to 65° C. Since the adhesive-base material is contained in the toner together with the polyester resin which is crosslinked, and elongation reacted, the toner has a desirable heat resistance preservation even having the lower glass transition temperature than that of the conventional polyester toners.

In the case that the glass transition temperature of the adhesive-base material is less than 30° C., it is liable to adversely affect on a heat resistance preservation of the toner. In the case that the glass transition temperature of the adhesive-base material is more than 70° C., low-temperature fixing properties of the toner is liable to be insufficient.

Storage modulus of the adhesive-base material is not particularly limited and can be appropriately adjusted in accordance with a purpose. For example, the temperature (TG') for achieving 10,000 dyne/$cm^2$ at frequency of 20 Hz is 100° C. or more, and preferably 110° C. to 200° C.

In the case that the temperature (TG') is less than 100° C., it is liable to adversely affect on offset resistance of the toner.

A viscosity of the adhesive-base material is not particularly limited and can be appropriately adjusted in accordance with a purpose. For example, the temperature (Tη) for achieving 1,000 poise (100 $Nm^{-2}$) at frequency of 20 Hz is 180° C. or less, and preferably 90° C. to 160° C.

In the case that the temperature (Tη) is more than 180° C., it is liable to adversely affect on low-temperature fixing properties of the toner.

From the view point of achieving both offset resistance and low-temperature fixing properties, therefore, it is preferable that the temperature (TG') is higher than the temperature (Tη). Namely, a difference from the temperature (TG') to the temperature (Tη), i.e., (TG'−Tη), is preferably 0° C. or more, more preferably 10° C. or more, and further preferably 20° C. or more. The larger the difference is more preferred.

From the view point of achieving both low-temperature fixing properties and heat resistance preservation, the aforementioned difference (TG'−Tη) is 0° C. to 100° C., preferably 10° C. to 90° C., and more preferably 20° C. to 80° C.

Specific examples of the adhesive-base material are not particularly limited and can be appropriately selected in accordance with a purpose. Suitable examples thereof are a polyester resin, and the like.

The polyester resin is not particularly limited and can be selected in accordance with a purpose. Suitable examples thereof are urea-modified polyester and the like.

The urea modified polyester which is obtained by reacting (B) amines as the active hydrogen-containing compound, and (A) a polyester prepolymer having an isocyanate group as the polymer capable of reacting with the active hydrogen-containing compound in the aqueous medium phase.

In addition, the urea modified polyester may include a urethane bond as well as a urea bond. A molar ratio of the urea bond content to the urethane bond content is preferably 100/0 to 10/90, more preferably 80/20 to 20/80, and further more preferably 60/40 to 30/70. In the case that a molar ratio of the urea bond is less than 10, it is liable to adversely affects on hot-offset resistance.

Specific examples of the urea-modified polyester are preferably the following (1)-(10):

(1) A mixture of (i) polycondensation product of bisphenol A ethyleneoxide dimole adduct and isophthalic acid, and (ii) urea-modified polyester prepolymer which is obtained by reacting isophorone disocyanate with a polycondensation product of bisphenol A ethyleneoxide dimole adduct and isophtalic acid so as to form polyester prepolymer, and modifying the polyester prepolymer with isophorone diamine;

(2) A mixture of (iii) a polycondensation product of bisphenol A ethyleneoxide dimole adduct and terephthalic acid, and (ii) urea-modified polyester prepolymer which is obtained by reacting isophorone disocyanate with a polycondensation product of bisphenol A ethyleneoxide dimole adduct and terephthalic acid so as to form polyester prepolymer, and modifying the polyester prepolymer with isophorone diamine;

(3) A mixture of (iv) polycondensation product of a bisphenol A ethyleneoxide dimole adduct, a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(4) A mixture of (vi) polycondensation product of a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(5) A mixture of (iii) polycondensation product of a bisphenol A ethyleneoxide dimole adduct and terephthalic acid, and (vii) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(6) A mixture of (iv) polycondensation product of a bisphenol A ethyleneoxide dimole adduct, a bisphenol A propyleneoxide dimole adduct and terephthalic acid, and (vii) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(7) A mixture of (iii) polycondensation product of a bisphenol A ethyleneoxide dimole adduct and terephthalic acid, and (viii) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with ethylene diamine;

(8) A mixture of (i) polycondensation product of a bisphenol A ethyleneoxide dimole adduct and isophthalic acid, and (ix) urea-modified polyester prepolymer which is obtained by reacting diphenylmethane disocyanate with a polycondensation product of a bisphenol A ethyleneoxide dimole adduct and isophthalic acid so as to form polyester prepolymer, and modifying the polyester prepolymer with hexamethylene diamine;

(9) A mixture of (iv) polycondensation product of a bisphenol A ethyleneoxide dimole adduct, a bisphenol A propyleneoxide dimole adduct and terephthalic acid, and (x) urea-modified polyester prepolymer which is obtained by reacting diphenylmethane disocyanate with a polycondensation product of a bisphenol A ethyleneoxide dimole adduct/bisphenol A propyleneoxide dimole adduct and terephthalic acid/dodecenylsuccinic anhydride so as to form polyester prepolymer, and modifying the polyester prepolymer with hexamethane diamine;

(10) A mixture of (i) polycondensation product of a bisphenol A ethyleneoxide dimole adduct and isophthalic acid, and (xi) urea-modified polyester prepolymer which is obtained by reacting toluene disocyanate with a polycondensation product of a bisphenol A ethyleneoxide dimole adduct and isophthalic acid so as to form polyester prepolymer, and modifying the polyester prepolymer with hexamethane diamine.

——Active Hydrogen Group-Containing Compound——

The active hydrogen group-containing compound functions as an elongation initiator or crosslinking agent at the time of elongation reactions or crosslinking reactions of the active hydrogen group-containing compound and the polymer capable of reacting with the active hydrogen group-containing compound in an aqueous medium.

The active hydrogen group-containing compound is not particularly limited, provided that it contains an active hydrogen group, and can be appropriately selected in accordance with a purpose. In the case that the polymer capable of reacting with the active hydrogen group-containing compound is (A) a polyester prepolymer containing an isocyanate group, the active hydrogen group-containing compound is preferably selected from (B) amines in view of capability of high molecular mass polymerization resulted from elongation reaction, crosslinking reaction, and the like.

In the active hydrogen group-containing compound, the active hydrogen group is not particularly limited, and can be appropriately selected in accordance with a purpose. Examples of the active hydrogen group are hydroxyl groups such as an alcoholic hydroxyl group, a phenolic hydroxyl group, and the like, carboxyl groups, mercapto groups, and the like, which can be used singly, or in combination of two or more thereof. Of these, the alcoholic hydroxyl group is particularly preferable.

The (B) amines are not particularly limited, and can be appropriately selected in accordance with a purpose. Examples of (B) amines are (B1) a divalent amine compound, (B2) a trivalent or more polyvalent amine compound, (B3) an aminoalcohol, (B4) an amino mercaptan, (B5) an amino acid, and (B6) a compound in which the amino group of B1 to B5 is blocked. Theses can be used singly, or in combination of two or more. Of these amines, the (B1) divalent amine compound, and a mixture of (B1) divalent amine compound and (B2) trivalent or more polyvalent amine compound are particularly preferable.

Examples of the (B1) divalent amine compound are: an aromatic diamine such as phenylene diamine, diethyl toluene diamine, 4,4'-diamino diphenyl methane; an alicyclic diamine such as 4,4'-diamino-3,3'-dimethyl dicyclohexyl methane, diamine cyclohexane, and isophorone diamine; and an aliphatic diamine such as ethylene diamine, tetramethylene diamine, and hexamethylene diamine.

Examples of the (B2) trivalent or more polyvalent amine compound are diethylene triamine, triethylene tetramine, and the like.

Examples of the (B3) aminoalcohol are ethanol amine, hydroxyethylaniline, and the like.

Examples of the (B4) amino mercaptan are aminoethyl mercaptan, aminopropyl mercaptan, and the like.

Examples of the (B5) amino acid are aminopropionic acid, aminocaproic acid, and the like.

Examples of the (B6) compound in which the amino group of B1 to B5 is blocked are: a ketimine compound obtained from the above-noted amines of B1 to B5 and ketones such as acetone, methyl ethyl ketone, and mehyl isobuthyl ketone; oxazolidine compound; and the like.

In order to stop cross-linking and/or elongation reactions of the active hydrogen group-containing compound and the polymer capable of reacting with the active hydrogen group-containing compound, a reaction stopper may be used as required to control the molecular mass of the adhesive-base material to be obtained. Examples of the reaction stopper are:

a monoamine such as diethyl amine, dibutyl amine, butyl amine, and lauryl amine; a compound in which the above-noted elements are blocked such as a ketimine compound; and the like.

A mixing ratio of (B) amines and (A) a polyester prepolymer having isocyanate group, defined as an equivalent ratio [NCO]/[NHx] of isocyanate group [NCO] in (A) a polyester prepolymer having isocyanate group to amine group [NHx] in (B) amines, is 1/3 to 3/1, preferably 1/2 to 2/1, and more preferably 1/1.5 to 1.5/1. When [NCO]/[NHx] is less than 1/3, the low-temperature fixing properties are degraded. When [NCO]/[NHx] is more than 3/1, on the other hand, the molecular mass of the urea-modified polyester becomes low, thereby degrading hot-offset resistance.

——Polymer Capable of Reacting with Active Hydrogen Group-Containing Compound——

The polymer capable of reacting with the active hydrogen group-containing compound, which may be simply referred to "a prepolymer", is not particularly limited, provided that it has a moiety capable of reacting with the active hydrogen group-containing compound, and can be appropriately selected in accordance with a purpose. Examples of the prepolymer are a polyol resin, a polyacrylic resin, a polyester resin, an epoxy resin, a modified resin thereof, and the like. Theses can be selected singly, or in combination of two or more. Of these examples, the polyester resin is particularly preferable in view of high flowability at the time of melting, and transparency.

The moiety capable of reacting with the active hydrogen group-containing compound is not particularly limited, and can be appropriately selected from the known substituents. Examples of such a moiety are an isocyanate group, an epoxy group, a carboxyl group, an acid chloride group, and the like. These may be selected singly or in combination of two or more. Of these examples, the isocyanate group is particularly preferable.

The prepolymer is particularly preferably a polyester resin containing a group capable of generating urea bonding (RMPE) in view of controllability of the molecular mass of high molecular substance, oil-less and low-temperature fixing properties of a dry toner, especially suitable releasing and fixing properties without a releasing oil applicator for a heating member for fixing.

Examples of the group capable of generating urea bonding are isocyanate group, and the like. In the case that the group capable of generating urea bonding in the polyester resin (RMPE) is the isocyanate group, the polyester resin (RMPE) is particularly preferably (A) a polyester prepolymer having an isocyanate group.

The (A) polyester prepolymer having an isocyanate group is not particularly limited, and can be selected in accordance with a purpose. Examples of the (A) polyester prepolymer having an isocyanate group are a polycondensation polyester of polyol (PO) and a polycarboxylic acid (PC), a reactant of the active hydrogen group-containing group and polyisocyanate (PIC), and the like.

The polyol (PO) is not particularly limited, and can be appropriately selected in accordance with a purpose.

Examples of the polyol (PO) are diol (DIO), trivalent or more polyhydric alcohol (TO), and a mixture of diol (DIO) and trivalent or more polyhydric alcohol (TO), and the like. These can be selected singly, or in combination of two or more. Of these examples, the diol (DIO) per se, or a mixture of the diol (DIO) and a little amount of the trivalent polyhydric alcohol (TIO) are preferably.

Examples of the diol (DIO) are alkylene glycol, alkylene ether glycol, alicyclic diol, alkylene oxide adduct of alicyclic diol, bisphenol, alkylene oxide adduct of bisphenol, and the like.

Examples of the alkylene glycol are alkylene glycol having 2-12 carbon atoms such as ethylene glycol, 1,2-propylene glycol, 1,3-propylene glycol, bytane-1,4-diol, hexane-1,6-diol and the like.

Examples of the alkylene ether glycol are diethylene glycol, triethylene glycol, dipropylene glycol, polyethylene glycol, polypropylene glycol, polytetramethylene ether glycol, and the like.

Examples of the alicyclic diol are cyclohexane-1,4-dimethanol, hydrogenated bisphenol A, and the like.

Examples of the alkylene oxide adduct of alicyclic diol are alicyclic diol selected from the above-listed alicyclic diols, adducted with alkylene oxide such as ethylene oxide, propylene oxide, butylene oxide, and the like.

Examples of the bisphenol are bisphenol A, bisphenol F, bisphenol S, and the like.

Examples of the alkylene oxide adduct of bisphenol are bisphenol selected from the above-listed bisphenols adducted with alkylene oxide such as ethylene oxide, propylene oxide, butylene oxide, and the like.

Of these examples, alkylene glycol having 2-12 carbon atoms, and alkylene oxide adduct of bisphenol are preferable, and alkylene oxide adduct of bisphenol, and a mixture of alkylene oxide adduct of bisphenol and alkylene glycol having 2-12 carbon atoms are particularly preferable.

The trivalent or more polyhydric alcohol (TO) is preferably polyhydric alcohol having a valency of 3 to 8, and/or a valency of 8 TO or more. Examples of such trivalent or more polyhydric alcohol (TO) are trivalent or more polyhydric aliphatic alcohol, trivalent or more polyphenol, alkylene oxide adduct of trivalent or more polyphenol, and the like.

Examples of the trivalent or more polyhydric aliphatic alcohol are glycerin, trimethylol methane, trimethylol propane, pentaerythritol, sorbitol, and the like.

Examples of the trivalent or more polyphenol are trisphenol PA, phenol novolac, cresol novolac, and the like.

Examples of the alkylene oxide adduct of trivalent or more polyphenol are the above-listed trivalent or more polyphenol adducted with alkylene oxide such as ethylene oxide, propylene oxide, butylene oxide, and the like.

In the mixture of the diol (DIO) and the trivalent or more polyhydric alcohol (TO), a mass ratio (DIO:TO) of the diol to the trivalent or more polyhydric alcohol is 100:0.01-10, and preferably 100:0.01-1.

The polycarboxylic acid (PC) is not particularly limited, and can be appropriately selected in accordance with a purpose. Examples of the polycarboxylic acid (PC) are dicarboxylic acid (DIC), trivalent or more polycarboxylic acid (TC), a mixture of dicarboxylic acid (DIC) and trivalent or more polycarboxylic acid (TC), and the like. These can be selected singly, or in combination of two or more. Among these example, dicarboxylic acid (DIC) alone or a mixture of dicarboxylic acid (DIC) and trivalent or more polycarboxylic acid (TC) is preferable.

Examples of the dicarboxylic acid are alkylene dicarboxylic acid, alkenylene dicarboxylic acid, aromatic dicarboxylic acid, and the like.

Examples of the alkylene dicarboxylic acid are succinic acid, adipic acid, sebacic acid, and the like.

Examples of the alkenylene dicarboxylic acid are alkenylene dicarboxylic acid having 4-20 carbon atoms, such as maleic acid, fumaric acid, and the like.

Examples of the aromatic dicarboxylic acid are aromatic dicarboxylic acids such as phthalic acid, isophthalic acid, terephthalic acid, naphthalene dicarboxylic acid, and the like.

Among these examples, alkenylene dicarboxylic acid having 4-20 carbon atoms, and aromatic dicarboxylic acid having 8-20 carbon atoms are preferable.

The trivalent or more polycarboxylic acid (TC) is preferably selected from trivalent to octavalency polycarboxylic acids, such as aromatic polycarboxylic acid.

Examples of the aromatic polycarboxylic acid are aromatic polycarboxylic acids having 9-20 carbon atoms such as trimellitic acid, pyromellitic acid, and the like.

The polycarboxylic acid (PC) may also be an acid anhydride or lower alkyl ester of one selected from the above-listed dicarboxylic acid (DIC), the above-listed trivalent or more polycarboxylic acid (TC), the above-listed mixture of dicarboxylic acid (DIC) and trivalent or more polycarboxylic acid (TC). Examples of the lower alkyl ester are methyl ester, ethyl ester, isopropyl ester, and the like.

In the mixture of dicarboxylic acid (DIC) and trivalent or more polycarboxylic acid (TC), a mass ratio (DIC:TC) of the dicarboxylic acid (DIC) to the trivalent or more polycarboxylic acid (TC) can be appropriately adjusted in accordance with a purpose without any limitation, and, for example, is preferably 100:0.1-10, preferably 100:0.01-1.

At the time of subjecting the polyol (PO) and the polycarboxylic acid (PC) polymerization condensation reaction, a mixing ratio thereof is not particularly limited, and can be selected in accordance with a purpose.

For example, a mixing ratio of the polyol (PO) to polyvalent carboxylic acid (PC), defined as an equivalent ratio [OH]/[COOH] of a hydroxyl group [OH] to a carboxyl group [COOH], is 2/1 to 1/1, preferably 1.5/1 to 1/1, and more preferably 1.3/1 to 1.02/1.

The polyol (PO) content of the (A) polyester prepolymer having an isocyanate group is not particularly, and can be adjusted in accordance with a purpose. Such a content is, for example, 0.5% by mass to 40% by mass, preferably 1% by mass to 30% by mass, and more preferably 2% by mass to 20% by mass.

In the case that the polyol (PO) content is less than 0.5% by mass, offset resistance becomes degraded, thereby being difficult to realize both heat resistance preservation and low-temperature fixing properties. In the case that the polyol (PO) content is more than 40% by mass, low-temperature fixing properties may become degraded.

The aforementioned polyvalent isocyanate (PIC) is not particularly limited, and can be appropriately selected in accordance with a purpose. Examples of the polyvalent isocyanate (PIC) are aliphatic polyvalent isocyanate, alicyclic polyvalent isocyanate, aromatic diisocyanate, aromatic aliphatic diisocyanate, isocyanurate, phenol derivative thereof, blocked products thereof with such as oxime, caprolactam, and the like.

Examples of the aliphatic polyvalent isocyanate are tetramethylen diisocyanate, hexamethylen diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, tetramethyl hexane diisocyanate, and the like.

Examples of the alicyclic polyvalent isocyanate are isophorone diisocyanate, cyclohexylmethane diisocyanate, and the like.

Examples of aromatic diisocyanate are tolylene diisocyanate, diphenylmethane diisocyanate, 1,5-naphthylene diisocyanate, diphenylene-4,4'-disocyanate, 4,4'-diisocyanato-3,3'-dimethyl diphenyl, 3-methyldiphenyl methane-4,4'-diisocyanate, diphenylether-4,4'-diisocyanate, and the like.

Examples of the aromatic aliphatic polyvalent isocyanate are α,α,α',α'-tetramethyl xylylene diisocyanate, and the like.

Examples of the isocyanurate are tris-isocyanatoalkyl-isocyanurate, triisocyanatocycroalkyl-isocyanurate, and the like.

These can be selected singly or in combination of two or more.

At the time of reacting the polyvalent isocyanate (PIC) and the active hydrogen group-containing polyester such as hydrogen group-containing polyester, a mixing ratio which is defined as an equivalent ratio [NCO]/[OH] of an isocyanate group [NCO] to a hydroxyl group [OH] of the hydroxyl group-containing polyester, is 5/1 to 1/1, preferably 4/1 to 1.2/1, and more preferably 3/1 to 1.5/1. In the case that the molar ratio of [NCO] in the ratio is more than 5, it is liable to degrade low-temperature fixing properties. In the case that the molar ratio of [NCO] is less than 1, it is liable to degrade offset resistance.

The polyvalent isocyanate (PIC) content of the (A) polyester prepolymer having an isocyanate group is 0.5% by mass to 40% by mass, preferably 1% by mass to 30% by mass, and more preferably 2% mass to 20% by mass. In the case that the content is less than 0.5% by mass, it is liable to degrade offset resistance. In the case that the content is more than 40% by mass, it is liable to degrade low-temperature fixing properties.

The average number of isocyanate groups contained in the (A) polyester prepolymer containing an isocyanate group is 1 or more per molecule of the (A) polyester prepolymer, preferably 1.2 to 5 per molecule, and more preferably 1.5 to 4 per molecule. In the case that the average number of isocyanate groups is less than 1 per molecule, the molecular mass of the urea modified polyester becomes low which makes hot-offset resistance poor.

The mass average molecular mass of the polymer capable of reacting with the active hydrogen group-containing compound is 1,000 to 30,000, and preferably 1,500 to 15,000, in terms of a molecular mass distribution of a tetrahydrofuran (THF) soluble part measured by means of gel permeation chromatography (GPC).

In the case that the mass average molecular mass (Mw) is less than 1,000, it is liable to degrade heat resistance preservation. In the case that mass average molecular mass (Mw) is more than 30,000, it is liable to degrade low-temperature fixing properties.

——Binder Resin——

The binder resin is not particularly limited, and can be appropriately selected in accordance with a purpose. Examples of the binder resin are polyester and the like. Of these examples, unmodified polyester (polyester which is not modified) is particularly preferable.

By containing the unmodified polyester in the toner, the toner can realize improved low-temperature fixing properties and glossiness.

Examples of the unmodified polyester are a resin equivalent to the aforementioned polyester resin containing a group capable of generating urea bonding (RMPE), i.e., polycondensation product of polyol (PO) and polycarboxylic acid (PC), and the like. The unmodified polyester is preferably compatible with the polyester resin containing a group capable of generating urea bonding (RMPE) at part thereof, i.e., having a similar polymeric structure which allow to be compatible, in view of low-temperature fixing properties and hot-offset resistance.

The mass average molecular mass (Mw) of the non-polyester is 1,000 to 30,000, preferably 1,500 to 15,000, more preferably 1,500 to 10,000, and particularly preferably 2,000 to 8,000 in terms of a molecular mass distribution of a tetrahydrofuran (THF) soluble part measured by means of gel permeation chromatography (GPC).

In the case that the mass average molecular mass (Mw) is less than 1,000, it is liable to degrade heat resistance preservation. Therefore, the amount of the unmodified polyester having a mass average molecular mass is 8% by mass to 28% by mass. In the case that mass average molecular mass (Mw) is more than 30,000, it is liable to degrade low-temperature fixing properties.

The glass transition temperature of the unmodified polyester is 30° C. to 70° C., preferably 35° C. to 70° C., more preferably 35° C. to 70° C., and particularly preferably 35° C. to 45° C. In the case that the glass transition temperature is lower than 30° C., it is liable to degrade heat resistance preservation of the toner. In the case that the glass transition temperature is higher than 70° C., it is liable to degrade lower-temperature fixing properties.

The hydroxyl value of the unmodified polyester is 5 mg KOH/g or more, preferable 10 mg KOH/g to 120 mg KOH/g, and more preferably 20 mg KOH/g to 80 mg KOH/g. In the case that the hydroxyl value is less than 5 mg KOH/g, it becomes difficult to achieve both heat resistance preservation and low-temperature fixing properties.

The acid value of the unmodified polyester is 1.0 mg KOH/g to 50.0 mg KOH/g, and preferably 3.0 mg KOH/g to 25.0 mg KOH/g. By imparting the acid value to the toner, the toner is generally liable to be negatively chargeable.

In the case that the hydroxyl value and the acid value are outside the aforementioned ranges, the toner is liable to be affected by the fluctuation of the environment, especially under high-temperature high-humidity or low-temperature low-humidity environment, and thus the formed image may be degraded.

When the unmodified polyester is contained in the toner, a mass ratio (RMPE/PE) of the urea-modified polyester (RMPE) to the unmodified polyester (PE) is 5/95 to 25/75, and preferably 10/90 to 25/75.

In the case that the mass ratio of the unmodified polyester (PE) is more than 95, it is liable to degrade offset resistance. In the case that the mass ratio of the unmodified polyester is less than 75, it is liable to degrade glossiness.

The unmodified polyester content in the binder resin is 50% by mass to 100% by mass, preferably 60% by mass to 90% by mass, and more preferably 70% by mass to 85% by mass. In the case that the content is less than 50% by mass, the low-temperature fixing properties may be degraded, and charging ability is adversely affected, due to an excessive amount of the modified polyester resin in the toner.

When the toner comprises the unmodified polyester and the crystalline polyester, the mixing mass ratio (a/b+c) of the urea-modified polyester (a), the unmodified polyester (b) and the crystalline polyester (c) is 5/95 to 25/75, preferably 10/90 to 25/75, more preferably 12/88 to 25/75, and particularly preferably 12/88 to 22/78. The mixing mass ratio (b/c) the unmodified polyester (b) and the crystalline polyester (c) is 99/1 to 50/50, preferably 95/5 to 60/40, and more preferably 90/10 to 65/35. In the case that the mixing mass ratios are outside the aforementioned ranges, the hot-offset resistance may be degraded, and it becomes difficult to attain both the heat-resistance preservation and low-temperature fixing properties.

——Aqueous Medium——

The aqueous medium is not particularly limited, and can be appropriately selected from the conventional medium in accordance with a purpose. Examples of the aqueous medium are water, a solvent compatible with water, a mixture thereof, and the like.

The solvent compatible with water is not particularly limited provided that it is compatible with water. Examples of the solvent compatible with water are alcohol, dimethyl formamide, tetrahydrofuran, Cellosolve, lower ketone, and the like.

Examples of the alcohol are methanol, isopropanol, ethylene glycol and the like. Examples of the Cellosolve (i.e., 2-ethoxyethanol) are methyl Cellosolve (i.e., 2-methoxyethanol), and the like. Examples of the lower ketone are acetone, methylethylketone, and the like. These can be selected singly or in combination of two or more.

—Other Components—

The other components are not particularly limited, and can be appropriately selected in accordance with a purpose. The other components to be contained are, for example, a colorant, a releasing agent, a charge controlling agent, inorganic particles, a flowability improver, a cleaning improver, a magnetic material, metal soap, and the like.

The colorant is not particularly limited, and can be appropriately selected in accordance with a purpose.

Examples of the colorant are carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and the like. Theses can be selected singly or in combination of two or more.

The colorant content of the toner is not particularly limited, and can be appropriately adjusted in accordance with a purpose. The colorant content is preferably 1% by mass to 15% by mass, and more preferably 3% by mass to 10% by mass.

In the case that the colorant content is less than 1% by mass, it is liable to lower tinting strength of the toner. In the case that the colorant content is more than 15% by mass, it is liable to adversely affect on the dispersibility of the colorant in the toner particles, which results in lowering tinting strength and charging ability of the toner.

The colorant may be used as a master batch compounded with a resin.

The resin for use is not particularly limited, and can be appropriately selected in accordance with a purpose. Examples of the binder resin in the master batch are styrene or substituted polymer thereof, styrene copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate, rosin, modified rosin, terpene resin, aliphatic hydrocarbon resin, alicyclic hydrocarbon resin, aromatic petroleum resin, chlorinated paraffin, paraffin, and the like. These can be selected singly, or in combination of two or more.

Examples of the styrene or substituted polymer thereof are polyester, polystyrene, poly-p-chlorostyrene, polyvinyl toluene, and the like. Examples of the styrene copolymer are styrene-p-clorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl-α-chloromethacylate copolymer, styrene-acrylonitril copolymer, styrene-vinylmethylketone copolymer, styrene-butadiene copolymer, styrene-isoprene copolymer, styrene-acrylonitrile-indene copolymer, styrene-maleic acid copolymer, styrene-maleic ester copolymer, and the like.

The master batch is prepared, for example, by mixing or kneading the resin for the master batch and the colorant at high shear force. During this process, it is preferable to add an organic solvent so as to enforce interaction between the colorant and the resin. In addition, flashing method is also preferable for preparing the master batch since the pigment can be employed in the form of wetcake without drying. In the flashing method, an aqueous paste of the pigment and water is mixed or kneaded together with the resin and the organic solvent, the colorant is gradually transferred into the resin, and then the water and organic solvent are removed. For the aforementioned fixing or kneading, high shear force dispersing device, such as three-roller mills and the like are suitably used.

The releasing agent is not particularly limited and can be selected from the conventional releasing agents in accordance with a purpose. Examples of the releasing agent are wax and the like.

Examples of the wax are a carbonyl group-containing wax, polyolefin wax, long-chain hydrocarbon, and the like. Each of these can be employed alone or in combination of two or more. Of these examples, the carbonyl group-containing wax is preferable.

Examples of the carbonyl group-containing wax are polyalkanoic ester, polyalkanol ester, polyalkanoic acid amide, polyalkyl amide, dialkyl ketone, and the like. Examples of the polyalkanoic ester are carnauba wax, montan wax, trimethylolpropane tribehenate, pentaerythritol tetrabehenate, pentaerythritol diacetate dibehenate, glycerin tribehenate, octadecan-1,18-diol distearate, and the like. Examples of the polyalkanol ester are trimellitic tristearate, distearyl maleate, and the like. Examples of the polyalkanoic acid amide are behenyl amide and the like. Examples of the polyalkyl amide are trimellitic acid tristearyl amide, and the like. Examples of the dialkyl ketone are distearyl ketone, and the like. Of these carbonyl group-containing wax, the polyalkanoic ester is particularly preferable.

Examples of the polyolefin wax are polyethylene wax, polypropylene wax, and the like.

Examples of the long-chain hydrocarbon are paraffin wax, Sasol Wax, and the like.

A melting point of the releasing agent is not particularly limited, and can be appropriately selected in accordance with a purpose. It is 40° C. to 160° C., preferably 50° C. to 120° C., and more preferably 60° C. to 90° C.

In the case that the melting point is less than 40° C., it adversely affects on heat-resistance preservation of the wax. In the case that the melting point is more than 160° C., it is liable to cause cold offset at a relatively low temperature at the time of fixing.

A melt viscosity of the wax is preferably 5 cps to 1,000 cps, and more preferably 10 cps to 100 cps by a measurement at a temperature of 20° C. higher than the melting point of the wax.

In the case that the melt viscosity is less than 5 cps, a releasing ability is liable to be insufficient. In the case that the melt viscosity is more than 1,000 cps, on the other hand, it may not improve offset resistance, and low-temperature fixing property.

The releasing agent content of the toner is not particularly limited, and can be appropriately adjusted in accordance with a purpose. For example, the releasing agent content is preferably 0 to 40% by mass, and more preferably 3% by mass to 30% by mass. In the case that the releasing agent content is more than 40% by mass, it is liable to degrade the flowability of the toner.

The charge controlling agent is not particularly limited, and can be appropriately selected from conventionally available ones in accordance with a purpose. The charge controlling agent is preferably formed of a material having a color close to transparent and/or white.

Examples of the charge controlling agent are triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, salicylic acid derivative metallic salt, and the like. These can be selected singly or in combination of two or more.

The charge controlling agent for use in the present invention is also selected from the commercially available products. Specifically examples thereof are: Bontron P-51 of a quaternary ammonium salt, Bontron E-82 of an oxynaphthoic acid metal complex, Bontron E-84 of a salicylic acid metal complrex, and Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.), quinacridone, azo pigment, and other high-molecular mass compounds having a functional group, such as sulfonic acid group, carboxyl group, and quaternary ammonium salt, and the like.

The charge controlling agent may be dissolved and/or dispersed in the toner material after kneading with the master batch. The charge controlling agent may also be added at the time of dissolving and dispersing in the organic solvent together with the toner material. In addition, the charge controlling agent may be added onto the surface of the toner particles after preparing the toner particles.

The usage amount of the charge controlling agent is determined depending on the type of a binder resin, presence or absence of an additive to be used as required, and the method for manufacturing a toner including a dispersion process and is not limited uniformly; preferably, to 100 parts by mass of binder resin, 0.1 part by mass to 10 parts by mass of the charge controlling agent is used and more preferably with 0.2 part by mass to 5 part by mass of the charge controlling agent. In the case that the usage amount is less than 0.1 parts by mass, charge may not be appropriately controlled. In the case that the charge controlling agent is more than 10 parts by mass, charge ability of the toner become exceedingly large, which lessens the effect of the charge controlling agent itself and increases in electrostatic attraction force with a developing roller, and causes degradations of developer fluidity and image density.

The inorganic particles are not particularly limited, and can be appropriately selected from the conventional fine inorganic particles.

Suitable examples thereof are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and the like. These may be selected singly, or in combination of two or more.

The primary particle diameter of the inorganic particle is preferably 5 nm to 2 μm, and more preferably 5 nm to 500 nm. The specific surface of the inorganic particle is preferably 20 $m^2/g$ to 500 $m^2/g$ according to BET method.

The inorganic particle content of the toner is preferably 0.01% by mass to 5.0% by mass, and more preferably 0.01% by mass to 2.0% by mass.

The aforementioned flowability improver is surface treated to have improved hydrophobic properties, and is capable of inhibiting the degradation of flowability or charging ability under high humidity environment.

Suitable examples of the flowability improver are a silane coupling agent, a sililating agent, a silane coupling agent having a fluorinated alkyl group, an organotitanate coupling agent, an aluminum coupling agent, silicone oil, modified silicone oil, and the like.

The aforementioned cleaning improver is added to the toner to remove the residual developer on a latent electrostatic image bearing member or a primary transferring member after transferring.

Suitable example of the cleaning improver are fatty acid metal salt for example metal salt of stearic acid, such as zinc stearate, calcium stearate, and the like, fine polymer particles formed by soap-free emulsion polymerization, such as fine polymethylmethacrylate particles and fine polyethylene particles, and the like. The fine polymer particles have preferably a narrow particle size distribution. It is preferred that the volume average particle diameter thereof is 0.01 μm to 1 μm.

The magnetic material is not particularly limited and can be appropriately selected from the conventional magnetic material in accordance with a purpose. Suitable examples thereof are magnetite, ferrite, and the like. Among these, one having a white color is preferable in terms of tone.

The toner preferably has the following volume average particle diameter (Dv), a ratio (Dv/Dn) of volume average particle diameter (Dv) to number average particle diameter (Dn), average circularity, penetration, low-temperature fixing properties, offset-occurring temperature, thermal characteristics, image density, BET specific surface area, and the like.

The volume average particle diameter (Dv) of the toner is preferably 3 μm to 8 μm.

In the case that the volume average particle diameter is less than 3 μm, the toner of two-component developer is liable to fuse onto carrier surfaces as a result of stirring in the developing unit for a long period, and a one-component developer is liable to cause a filming to a developing roller or fusion to a member such as a blade for reducing a thickness of a toner layer formed onto a developing roller.

In the case that the volume average particle diameter is more than 8 μm, an image of high resolution and high quality is rarely obtained, and the mean toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.00 to 1.25, and more preferably 1.10 to 1.25, In the case that the ratio is less than 1.00, the toner of a two-component developer is liable to fuse onto carrier surfaces due to stirring in a developing unit for a long-period, thereby degrading a charging ability of the carrier or cleaning properties, and a one-component developer is liable to cause a filming to a developing roller or fusion to a member such as a blade for reducing a thickness of a toner layer formed onto a developing roller. In the case that the ratio is more than 1.25, an image of high resolution and high quality is rarely obtained, and the mean toner particle diameter is liable to fluctuate when a toner is repeatedly added to the developer to compensate the consumed toner.

The volume average particle diameter and the ratio (Dv/Dn) are measured, for example, by means of a particle size analyzer, MultiSizer II, manufactured by Beckmann Coulter Inc, The average circularity is an amount which a circumference of an equivalent circle having the same projected area to the toner particle shape minuses a boundary length of the actual toner particle. The average circularity is preferably 0.900 to 0.980, and more preferably 0.950 to 0.975. It is preferable that the amount of the particles having the average circularity of less than 0.940 is 15% or less with respect to the total amount of the toner.

In the case that the average circularity is less than 0.900, it may not be able to attain sufficient transfer properties and high quality images without scattering.

In the case that the average circularity is more than 0.980, it is liable to cause image smears resulted from cleaning failure to a latent electrostatic image bearing member and a transferring belt in an image-forming system utilizing a cleaning blade. Specifically, in the case of a formation of images having large image area such as photographic images, a toner forming an image remains on a latent electrostatic image bearing member due to paper feed failure or the like, and becomes a residual toner. Such a residual toner is accumulated on the latent electrostatic image bearing member and the accumulated residual toner causes background smear on the formed image, or pollutes a charging roller which contact-charges the latent electrostatic image bearing member so that the charging roller is unable to exhibit original charging ability.

The average circularity is measured, for example, by an optical detection zone method in which a suspension containing the toner is passed through an image-detection zone disposed on a plate, the particle images of the toner are optically detected by means of a CCD camera, and the obtained particle images are analyzed. For example, Flow-type particle image analyzer FPIA-2100 (manufactured by Sysmex Corp.) is employed for such a method.

The penetration is 15 mm or more, and preferably 20 mm to 30 mm in accordance with a penetration test (JIS K2235-1991).

In the case that the penetration is less than 15 mm, it is liable to degrade heat resistance preservation.

The penetration is measured in accordance with JIS K2235-1991. Specifically, the penetration is measure by filling a toner into a 50 ml glass container, leaving the glass container filled with the toner in a thermostat of 50° C. for 20 hours, sequentially cooling the toner to an ambient temperature, and then carrying out a penetration test thereto. Note that, the higher the penetration is, more excellent heat resistance preservation the toner has.

As the low-temperature fixing properties of the toner, the lowest fixing temperature is preferably as low as possible, and the offset-occurring temperature is preferably as high as possible, in view of realizing both lower fixing temperature and prevention of offset. When the lowest fixing temperature is less than 150° C. and the offset-occurring temperature is 200° C. or more, both the lower fixing temperature and prevention of offset are realized.

The lowest fixing temperature is determined as follow. A transfer sheet is set in an image-forming apparatus, a copy test is carried out, the thus obtained fixed image is scrubbed by pads, and the persistence of the image density is measured. The lowest fixing temperature is determined as a temperature at which the persistence of the image density becomes 70% or more.

The offset-occurring temperature is measured as follow. A transfer sheet is set in an image-forming apparatus, and the image-forming apparatus is adjusted so as to develop a solid image in each color of yellow, magenta, and cyan, as well as intermediate colors of red, blue, and green, and so as to vary the temperature of a fixing belt. The offset-occurring temperature is determined as the highest fixing temperature at which offset does not occur.

The thermal characteristics are also referred to flow tester characteristics, and are evaluated by softening temperature (Ts), flow-beginning temperature (Tfb), ½ method softening temperature (T½), and the like.

These thermal characteristics are measured by an appropriately selected method. For example, the thermal characteristics are obtained from a flow carve measured by means of a capillary flow tester CFT500 manufactured by Shimadzu Corp.

The softening temperature (Ts) is not particularly limited, and can be appropriately adjusted in accordance with a purpose. It is preferably 30° C. or more, and more preferably 50° C. to 120° C. In the case that the softening temperature (Ts) is less than 30° C., at least one of the heat resistance preservation or low-temperature preservation may be degraded.

The flow-beginning temperature (Tfb) is not particularly limited, and can be appropriately adjusted in accordance with a purpose. It is preferably 50° C. or more, and more preferably 60° C. to 150° C. In the case that the flow-beginning temperature (Tfb) is less than 50° C., at least one of the heat resistance preservation or low-temperature preservation may be degraded.

The ½ method softening temperature (T½) is not particularly limited, and can be appropriately adjusted in accordance with a purpose. It is preferably 60° C. or more, and more preferably 80° C. to 170° C. In the case that the ½ method softening temperature (T½) is less than 60° C., at least one of the heat resistance preservation or low-temperature preservation may be degraded.

The image density is determined as a density value measured by means of a spectrometer (SpectroDensitometer 938, manufactured by X-Rite), and is preferably 1.40 or more, more preferably 1.45 or more, and furthermore preferably 1.50 or more.

In the case that the image density is less than 1.40, the image density is low and thus a high quality image may not be obtained.

The image density is measured as follow. A solid image is formed by using a transfer sheet (Type 6200 manufactured by Ricoh Company, Ltd.), and a tandem-type color photocopier (Imagio Neo 450, manufactured by Ricoh Company, Ltd.) The photocopier was adjusted so that 1.00±0.1 mg/cm$^2$ of toner is transferred onto the sheet, and the transferred image is fixed by the fixing roller having a surface temperature of 160±2° C. The thus obtained solid image is subjected to a measurement of glossines by means of a spectrometer (SpectroDensitometer 938. manufactured by X-Rite), and an average value of measurements at arbitrary selected tree points in the solid image is calculated.

The BET specific surface area of the toner is preferably 0.5 m$^2$/g to 8.0 m$^2$/g, and more preferably 0.5 m$^2$/g to 7.5 m$^2$/g. When the BET specific surface area is less than 0.5 m$^2$/g, it is in a condition such that the residual resin particles form a coating layer onto the surface of the toner particle or intensively covers all around the surface of the toner particle. In such a condition, the resin particles inhibit the adhesion between a recording medium and the binder resinous components within the toner particle, and thus the lowest fixing-temperature may be increased. When the BET specific surface area is more than 8.0 m$^2$/g, the toner particles inhibit the wax ooze, and thus the wax cannot exhibit its releasing effects which prevent offset.

The specific surface area of the toner is measured in accordance with a BET method. For example, the specific surface area is measured by adsorbing nitrogen gas onto the surface of sample by means of Micromeritics Surface Area and Porosimetry Analyzer TriStar 3000 manufactured by Shimadzu Corporation in accordance with a multiple points BET method.

The coloration of the toner is not particularly limited, and can be appropriately selected in accordance with a purpose. For example, the coloration is at least one selected from a black toner, a cyan toner, a magenta toner, and a yellow toner. Each color toner is obtained by appropriately selecting the colorant to be contained therein.

As the amount of emulsifiers, dispersants, ionic impurities attached on the surface of the toner is very small, the toner of the present invention has an excellent charging ability, desirable shelf stability under various environmental conditions, and an excellent low-temperature fixing properties, and forms high quality images. When the toner comprises particles containing an adhesive-base material formed by reacting an active hydrogen-group containing compound and polymer capable of reacting with an active hydrogen-group containing compound, moreover, the toner excels in various properties such as aggregation resistance, charging ability, flowability, transfer properties, fixing properties and the like. Accordingly, the toner of the present invention can be utilized for various fields, especially for an image formation in accordance with electrophotography. The toner of the present invention is suitably applicable for an image-forming method, and can be also applied in a developer, a process cartridge, and an image-forming apparatus.

(Method for Producing Toner)

The method for producing a toner of the present invention comprises granulating a toner, and subjecting the granulated toner to at least washing with an alkali washing solution and washing with a neutral washing solution. The method of the present invention may further comprises appropriately selected other steps, if necessary.

<Granulating>

The granulating a toner is a step of granulating a toner comprising the aforementioned polyester.

Note that a toner obtainable by the granulating, but before being dried may be also referred to "wet-cake" or "filtered cake" in the specification.

The granulating is not particularly limited and can be appropriately selected from the conventional granulation steps in the conventional suspension-polymerization method, emulsification-polymerization method, dissolution-suspension method or the like, provided that the toner is suitably granulated. The granulating is preferably a step of emulsifying and/or dispersing an active hydrogen-group containing compound and polymer capable of reacting with an active hydrogen-group containing compound in an aqueous medium, allowing the active hydrogen-group containing compound and the polymer to react in the aqueous medium to thereby forming an adhesive-base material as well as particles containing the adhesive-base material, In course of the granulating, there are performed a preparation of an aqueous medium phase, a preparation of an organic solvent phase, a preparation of emulsion and/or dispersion, and others (synthesis of the polymer capable of reacting with an active hydrogen group-containing compound (prepolymer), synthesis of the active hydrogen group-containing compound, and the like).

The aqueous medium phase is prepared, for example, by dispersing the resin particles in the aqueous medium. The added amount of the resin particles to the aqueous medium is not particularly limited, and can be appropriately adjusted in accordance with a purpose. It is preferably that the added amount of the resin particles is preferably 0.5% by mass to 10% by mass.

The oil phase comprises, for example, at least one of monomer, polymer, an active hydrogen group-containing compound, and a polymer capable of reacting with an active hydrogen group-containing compound. The oil phase optionally further comprises a toner material containing other components such as a colorant, a releasing agent, a charge controlling agent, and the like. Preferably, the oil phase comprises an organic solvent together with the toner material, and is formed by dissolving and/or dispersing the toner material in the organic solvent.

The organic solvent is not particularly limited, and can be appropriately selected in accordance with a purpose, provided that the organic solvent allows the toner material to be dissolved and/or dispersed therein. It is preferable that the organic solvent is a volatile organic solvent having a boiling point of less than 150° C. in view of easy removal thereof. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these organic solvents, toluene, xylene, benzene, methylene chloride, 1,2-dichloroethane, chloroform, carbon tetrachloride are preferable, and methyl acetate is more preferable. These solvents can be selected singly or in combination. The usage amount of the organic solvent is preferable from 40 to 300 parts by mass, more preferably from 60 to 140 parts by mass, and furthermore preferably from 80 to 120 parts by mass with respect to 100 parts by mass of the toner material.

The preparation of emulsion and/or dispersion is preferably performed by emulsifying and/or dispersing the previously prepared organic solvent phase in the previously prepared aqueous medium phase. At the time of emulsifying and/or dispersing, the active hydrogen group-containing compound and the polymer capable of reacting therewith are allowed to elongation reaction and/or crosslinking reaction to thereby form an adhesive-base material at the time of the emulsifying and/or dispersing.

The adhesive-base material (e.g. the aforementioned urea-modified polyester) is formed, for example, by the following method (1)-(3):

(1) the oil phase the polymer capable of reacting with the active hydrogen group-containing compound (e.g. (A) polyester prepolymer containing an isocyanate group) is emulsified and/or dispersed in the aqueous medium phase together with the active hydrogen group-containing compound so as to form the dispersed droplets, and then the active hydrogen group-containing compound and the polymer capable of reacting with the active hydrogen group-containing compound are subjected to elongation and/or crosslinking reaction in the aqueous medium phase;

(2) the oil phase is emulsified and/or dispersed in the aqueous medium phase previously added with the active hydrogen group-containing compound to form the dispersed droplets, and then the active hydrogen group-containing compound and the polymer capable of reacting with the active hydrogen group-containing compound are subjected to elongation and/or crosslinking reaction in the aqueous medium phase;

(3) the oil phase is added and mixed in the aqueous medium phase, the active hydrogen group-containing compound is sequentially added thereto so as to form the dispersed droplets, and then the active hydrogen group-containing compound and the polymer capable of reacting with the active hydrogen group-containing compound are subjected to elongation and/or crosslinking reaction at an interface of dispersed particles in the aqueous medium phase.

In the case of the method (3), it should be noted that modified polyester is initially formed from a surface of the thus obtained toner particles, and thus it is possible to form a contrast of the modified polyester in the toner particles.

Conditions for forming the adhesive-base material by the emulsifying and/or dispersing are not particularly limited, and can be appropriately adjusted in accordance with a combination of the active hydrogen group-containing compound and the polymer capable of reacting therewith. A suitable reaction time is preferable 10 minutes to 40 hours, and more preferably 2 hours to 24 hours. A suitable reaction temperature is preferably 0 to 150° C., and more preferably 40° C. to 98° C.

A suitable formation of the dispersed droplets containing the active hydrogen group-containing compound and the polymer capable of reacting with the active hydrogen group-containing compound (e.g. the (A) polyester prepolymer containing an isocyanate group) in the aqueous medium phase is realized by, to the aqueous medium phase, adding the oil phase in which the toner material such as the polymer (e.g. the (A) polyester prepolymer containing an isocyanate group), the colorant, the wax, the charge controlling agent, the unmodified polyester and the like is dissolved and/or dispersed in the organic solvent, and dispersing by a shear force.

The method of dispersing is not particularly limited, and can be appropriately selected from usage of the conventional dispersers. Examples of such dispersers are a low-speed-shear disperser, a high-speed-shear disperser, a friction disperser, a high-pressure-jet disperser, an ultrasonic disperser and the like. Among these, the high-speed-shear disperser is preferable in view of that it is capable of controlling the size of the dispersed droplets (dispersed particles) at 2 μm to 20 μm.

In the case that the high-speed-shear disperser is selected as a disperser, the conditions such as rotation frequency, dispersing time, peripheral velocity of a stirring blade, dispersing temperature and the like are not particularly limited, and can be appropriately adjusted in accordance with a purpose. For example, the rotation frequency is preferably 1,000 rpm to 30,000 rpm, and more preferably 5,000 rpm to 20,000 rpm. In the case of the batch method, the dispersing time is preferably 0.1 minutes to 5 minutes, and the dispersing temperature is preferably 0 to 150° C., and more preferably 40° C. to 98° C. under pressure. Generally speaking, the dispersion is more easily carried out at a high dispersing temperature.

In course of preparing the dispersion, the usage amount of the aqueous medium phase is preferably 50 parts by mass to 2,000 parts by mass, and more preferably 100 parts by mass to 1,000 parts by mass with respect to the 100 parts by mass of the toner material.

In the case that the usage amount of less than 50 parts by mass, the toner material is not desirably dispersed, and thus toner particles having a predetermined particle diameter are rarely obtained. In the case that the usage amount is more than 2,000 parts by mass, on the other hand, the production cost is liable to increase.

In course of emulsifying and/or dispersing, a dispersant is preferably used in order to sharpen the particle size distribution and to stably perform a dispersing procedure.

The dispersant is not particularly limited, and can be appropriately selected in accordance with a purpose. Suitable examples of the dispersant are a surfactant, water-insoluble inorganic dispersant, polymeric protective colloid, and the like. These can be used singly or in combination of two or more.

Examples of the surfactant are an anionic surfactant, a cationic surfactant, a nonionic surfactant, an ampholytic surfactant.

Examples of the anionic surfactant are alkylbenzene sulfonic acid salts, α-olefin sulfonic acid salts, phosphoric acid salts, and the like. Among these, the anionic surfactant having a fluoroalkyl group is preferable. Examples of the anionic surfactant having a fluoroalkyl group are fluoroalkyl carboxylic acid having 2-10 carbon atoms or a metal salt thereof, disodium perfluorooctanesulfonylglutamate, sodium-3-{omega-fluoroalkyl ($C_6$ to $C_{11}$)oxy}-1-alkyl($C_3$ to $C_4$) sulfonate, sodium-3-{omega-fluoroalkanoyl($C_6$ to $C_8$)—N-ethylamino}-1-propanesulfonate, fluoroalkyl($C_{11}$ to $C_{20}$) carboxylic acid or a metal salt thereof, perfluoroalkyl($C_7$ to $C_{11}$) carboxylic acid or a metal salt thereof, perfluoroalkyl($C_4$ to $C_{12}$) sulfonic acid or a metal salt thereof, perfluorooctanesulfonic acid diethanol amide, N-propyl-N-(2-hydroxyethyl) perfluorooctane sulfone amide, perfluoroalkyl($C_6$ to $C_{10}$) sulfone amidepropyltrimethylammonium salt, a salt of perfluoroalkyl ($C_6$ to $C_{10}$)—N-ethylsulfonyl glycin, monoperfluoroalkyl($C_6$ to $C_{16}$)ethylphosphate, and the like. Examples of the commercially available surfactant having a fluoroalkyl group are: Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactant are amine salt, quaternary amine salt, and the like. Examples of the amine salt are alkyl amine salt, aminoalcohol fatty acid derivative, polyamine fatty acid derivative, imidazoline, and the like. Examples of the quaternary ammonium salt are alkyltrimethyl ammonium salt, dialkyldimethyl ammonium salt, alkyldimethyl benzyl ammonium salt, pyridinium salt, alkyl isoquinolinium salt, benzethonium chloride, and the like. Among these, preferable examples are primary, secondary or tertiary aliphatic amine having a fluoroalkyl group, aliphatic quaternary ammonium salt such as perfluoroalkyl($C_6$ to $C_{10}$) sulfoneamidepropyltrimethylammonium salt, benzalkonium salt, benzetonium chloride, pyridinium salt, imidazolinium salt, and the like. Specific examples of the commercially available product thereof are Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

Examples of the nonionic surfactant are fatty acid amide derivative, polyhydric alcohol derivative, and the like.

Examples of the ampholytic surfactant are alanine, dodecyldi(aminoethyl) glycin, di(octylaminoethyle) glycin, N-alkyl-N,N-dimethylammonium betaine, and the like.

Examples of the water-insoluble inorganic dispersant are tricalcium phosphate, calcium carbonate, titanium oxide, colloidal silica, hydroxyl apatite, and the like.

Examples of the polymeric protective colloid are acid, (meth)acryl monomer having a hydroxyl group, vinyl alcohol or ester thereof, ester of vinyl alcohol and a compound having a carboxyl group, amide compound or methylol compound thereof, chloride, monopolymer or copolymer having a nitrogen atom or heterocyclic ring thereof, polyoxyethylene, cellulose, and the like.

Examples of the acid are acrylic acid, methacrylic acid, α-cycnoacrylic acid, α-cycnomethacrylic acid, itaconic acid, crotonic acid, fumaric acid, maleic acid, maleic anhydride, and the like.

Examples of the (meth)acryl monomer having a hydroxyl group are β-hydroxyethyl acrylate, β-hydroxyethyl methacrylate, β-hydroxypropyl acrylate, β-hydroxypropyl methacrylate, γ-hydroxypropyl acrylate, γ-hydroxypropyl acrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, glycerin monomethacrylate, N-methylol acrylamido, N-methylol methacrylamide, and the like.

Examples of the vinyl alcohol or ester or vinyl alcohol are vinyl methyl ether, vinyl ethyl ether, vinyl propyl ether, and the like.

Examples of the ester of vinyl alcohol and a compound having a carboxyl group are vinyl acetate, vinyl propionate, vinyl butyrate, and the like.

Examples of the amide compound or methylol compound thereof are acryl amide, methacryl amide, diacetone acrylic amide acid, or methylol thereof, and the like.

Examples of the chloride are acrylic chloride, methacrylic chloride, and the like.

Examples of the monopolymer or copolymer having a nitrogen atom or heterocyclic ring thereof, are vinyl pyridine, vinyl pyrrolidone, vinyl imidazole, etjulene imine, and the like.

Examples of the polyoxyethylene are polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, polyoxyethylene nonylphenyl ester, and the like.

Examples pf the cellulose are methyl cellulose, hydroxyethyl cellulose, hydroxypropyl cellulose, and the like.

In the preparation of the dispersion, a dispersing stabilizer is employed, if necessary. The dispersing stabilizer is, for example, acid such as calcium phosphate, alkali-soluble compound, or the like.

In the case that the dispersing stabilizer is employed, the dispersing stabilizer is dissolved by acid such as hydrochloric acid, and then is washed with water or decomposed by a enzyme, thereby being removed from particles.

In the preparation of the emulsion and/or dispersion, a catalyst for the elongation and/or crosslinking reaction is employed, if necessary. The catalyst is, for example, dibutyltin laurate, dioctyltin laurate, and the like.

The organic solvent is removed from the thus obtained dispersion (emulsified slurry).

The method for removing the organic solvent are: (1) a method in which an emulsion and/or dispersion is gradually heated so as to completely evaporate the organic solvent in the dispersed droplets; (2) a method in which an emulsified dispersion is sprayed in a dry atmosphere, and the water-insoluble organic solvent in the dispersed droplets is removed to form toner particles as well as completely evaporating the aqueous dispersant; and the like.

The dry atmosphere at which the emulsified dispersion is sprayed is not particularly limited, and can be selected in accordance with a purpose. Examples of such dry atmosphere are heated gas such as air, $N_2$ gas, $CO_2$ gas, combustion gas and the like. More suitably examples are ventilating current of the aforementioned gas heated at higher temperature than the highest boiling temperature of the organic solvents for use. In addition, the dry atmosphere may be formed, for example, by a spry dryer, belt dryer, or rotary kiln for a short-period of time.

Once the organic solvent is removed, the toner particles are formed.

The toner comprising the polyester resin is formed by the aforementioned steps.

<Washing>

The washing is to subject the granulated toner at least with an alkali washing solution, wherein the total organic carbon amount extractable from the alkali-washed toner is 200 ppm/g or less. In the course of the washing, the emulsifiers, dispersants, ionic impurities and the like attached on the surface of the toner or the resin particles are removed, and thus the charging ability of the toner is improved.

The toner after subjected to the washing and before subjected to the external-additive mixing may be also referred to "toner-base particle(s)" in the specification.

Note that "ppm/g" denotes an amount of carbon within the extracted organic substances from 1 g of a dry toner. In the case that the washing with the alkali washing solution is performed more than once, the total organic carbon (TOC) amount of 200 ppm/g or less is extracted at least from the toner after being subjected to the final alkali-washing.

In the washing, it is preferred that the extractable total organic carbon amount in the alkali washing solution after the final alkali washing is less. It is 200 ppm/g or less, preferably 150 ppm/g or less, and more preferably 100 ppm/g or less. In the case that the extractable TOC amount is more than 200 ppm/g, the charging ability may be degraded, especially under high temperature and/or high humidity environment.

The analysis method of the extractable total organic carbon (TOC) amount is performed, for example, by measuring the extracted total organic carbon amount from the alkali-washed toner by means of TOC analyzer, TOC-5000A, manufactured by Shimadzu Corporation, in the following manner:

(1) In the case that a sample is wet-cake or dispersion, a solid content (% by mass) of the sample is measured. When the sample is a solid toner, a solid content thereof is 100% by mass.
(2) 7.5 g of the sample (wet-cake, dispersion, toner, etc.) is precisely weighted in a 140 ml bottle (S1).
(3) To the bottle of (2) is added 47.5 g of KOH aqueous solution exhibiting pH 9.
(4) Ultrasonic is imparted to the mixture at 30° C. or lower for 30 minutes.
(5) About 1.5 ml of the mixture is subjected to centrifugal separation in a microtube.
(6) Supernatant of the separated mixture is filtered by 0.2 μm microfilter so as to remove fine particles, and the rest of the supernatant is poured back to the microtube.
(7) The filter is washed by tap-water and then by pure water, and then the depositions of the separated mixture obtained in (5) are filtered by 1 μm microfilter.
(8) To the filtrate obtained in (7) is added two drops of HCl (35% by mass) aqueous solution, and pH of the mixed solution is confirmed to be 3 or less.
(9) The mixed solution obtained in (8) is precisely weighted (T1).
(10) The mixed solution obtained in (8) is added and diluted with pure water so that the total weight to be 6.0 mg, and then is precisely weighted (T2).
(11) The thus obtained solution is heated or combusted at a high temperature so as to generate the carbon in the organic substances in the solution as carbonic acid gas, and the extracted TOC amount is measured by analyzing the carbonic acid gas by infrared spectroscopy.
(12) The TOC amount can be calculated by the following equation. TOC (ppm/g)=TOC measurement×(S1+S2)/{S1×(Solid content (mass %)/100)}×T2/T1)

The washing is nor particularly limited and can be appropriately adjusted in accordance with a purpose, provided that at least the alkali washing is performed. The washing is preferably to subject the granulated toner to washing with the alkali washing solution (also referred as alkali washing), washing with water (also referred as water washing), washing the acid washing solution (also referred as acid washing), and washing with water (water washing), or preferably to subject the granulated toner to washing with the alkali washing solution (alkali washing), washing with water (water washing), washing the acid washing solution (acid washing), washing with water (water washing), washing with the alkali washing solution (alkali washing) and washing with water (water washing), or the like.

When the alkali washing is performed, emulsifiers, dispersants, ionic impurities, and the like attached on the toner surface can be removed.

In the toner comprising particles containing the adhesive-base material therein, the resin particles are utilized as a dispersion (emulsification) stabilizer so as to sharpen the particle size distribution of the toner. If such resin particles are excessively attached onto the toner surface, the resin particles are liable to inhibit fixing of the toner or adversely affect on the chargeability of the toner. Therefore, such excessive resin particles are preferably removed from the toner surface. Since the resin particles contain acid components, they can easily be removed by swelling or dissolving in course of the alkali washing. In the production of the toner, moreover, the amines are utilized to generate the adhesive-base material. If a part of the amines is remained without being reacted, such remained amines form aggregates with acid groups (carboxyl groups) of the polyester. This formation of the aggregates is liable to retard elongation reaction after emulsification, adversely affect on the chargeability due to lowered acidity of the polyester, or lower the adhesion between the toner and the paper. As a result of the alkali washing, a hydrogen atom in the terminal carboxyl group of the polyester is substituted with a sodium atom. If the acid washing is performed thereafter, the terminal carboxyl group of the polyester is recovered, and the elongation reaction is once again proceeded.

—Alkali Washing—

In the alkali washing, the pH of the alkali washing solution after washing is 6.0 to 11.0, and preferably 7.0 to 10.0. In the case that pH is less than 6.0, the improved charging ability or shelf stability by the alkali washing cannot be attained. In the case that pH is more than 11.0, the polyester is liable to induce hydrolysis reaction which is not preferable.

The temperature T (° C.) of the alkali washing solution at the time of alkali washing is not particularly limited and can be appropriately adjusted in accordance with a purpose, provided that the toner does not melt or attached to each other. It is 10° C. to 70° C., and preferably 15° C. to 60° C. When the glass transition temperature of the toner is denoted as Tg (° C.), it is more preferred that the temperature of the alkali washing and the glass transition temperature of the toner satisfy the following relationship.

$$(Tg-10) \leqq (Tg+10)$$

In the case that the temperature of the alkali washing is around Tg, the charging ability of the toner is further improved. This is because high molecular chain is allow to move at the temperature around Tg, the impurities contained in the matrix or toner surface are more easily removed, and polar groups such as carboxyl groups which contribute to the charging ability are more easily come to the surface of the toner.

The time-period required for the alkali washing is not particularly limited provided that the polyester does not induce hydrolysis reaction, and depends on the pH of the alkali washing solution or the like. It is preferably 1 hour to 72 hours, and more preferably 1 hour to 30 hours in view of productivity or work efficiency.

In the alkali washing, it is preferred that a hydrogen atom of the carboxyl group is substituted by a sodium atom after washing. In the process of the alkali washing, the terminal carboxyl group of the polyester is substituted by a sodium atom to form a terminal group —COON, and thus there is obtained a toner having an excellent charging ability and excellent charge rising.

The alkali washing solution is not particularly limited and can be appropriately selected from the conventional alkali solution, provided that it is an alkaline aqueous solution. Examples thereof are an aqueous solution of alkali metal salt such as sodium hydroxide, and potassium hydroxide, an aqueous solution of ammonium, and the like. These can be employed can be singly or in combination of two or more. Of these examples, an aqueous solution of sodium hydroxide is the most preferable.

After the alkali washing, the alkali washing solution is preferably subjected to solid-liquid separation. In course of the alkali washing, impurities, such as resin particles described hereinafter, are removed from the toner surface as solid particles. If the alkali washing solution is separated by filtration to collect the toner, for example, the impurities are also collected together with the toner, and thus remain in the toner.

The method of the solid-liquid separation is not particularly limited, and can be appropriately selected. For example, the solid-liquid separation is performed by a decanter (solid-liquid separation device).

—Water Washing—

The water washing is performed preferably after the alkali washing. In the case that the acid washing is performed after the alkali washing without the water washing therebetween, anionic impurities are reattached to the surface of the toner or the resin particles before being completely washed out, and the washing becomes insufficient. Therefore, the charging ability cannot be improved or the shelf stability cannot be maintained.

The water for the water washing is preferably dionized water.

The conductivity of the water after the alkali washing, solid-liquid separating and the water washing the toner is 0.5 μS/cm to 60 μS/cm, and preferably 2 μS/cm to 20 μS/cm. In the case that the conductivity is less than 0.5 μS/cm or more than 60 μS/cm, the charging ability may not be improved.

In order to maintain the conductivity within the aforementioned range, anionic impurities attached on the surface of the toner or the resin particles should be removed. It is preferred that water washing is performed sequential to the alkali washing so as to prevent the anionic impurities from reattaching to the toner or the resin particles.

—Acid Washing—

In the acid washing, the washing solution (slurry) of the acid washing has pH of 1 to 5, preferably 1 to 4.

The conductivity of the acid washing solution after washing is important in view of improving the charging ability or maintaining the shelf stability, likewise the alkali washing.

Specifically, it is preferably 60 μS/cm or less. In the case that the conductivity is less than 60 μS/cm, the charging ability may not be improved.

In order to control the conductivity within the aforementioned range, the cationic impurities should be removed. For example, it is preferred that the water washing is performed sequential to the acid washing so as to prevent the cationic impurities from reattaching the surface of the toner or the resin particles.

The temperature and time for the acid washing are identical to those of the alkali washing.

In the acid washing, it is preferred that the terminal carboxyl group —COOH of the polyester is not substituted after washing. When the terminal group is the unsubstituted carboxyl group —COOH, there is obtained a toner which is liable to improve a compatibility to a paper due to high polarity of the polyester resin, and thus the lowest fixing temperature is lowered. In addition, such a toner is liable to be a negative chargeable.

The acid washing solution is not particularly limited and can be appropriately selected from the conventional acid solution. Examples thereof are aqueous solutions of hydrochloric acid, acetic acid, phosphoric acid, nitric acid, and the like. These can be employed singly or in combination of two or more. Of these examples, an aqueous solution of hydrochloric acid and an aqueous solution of nitric acid are preferable.

As described above, the granulated toner is subjected to at least washing with an alkali washing solution, wherein a total organic carbon (TOC) amount extractable from the alkali-washed toner is 200 ppm/g or less after washing.

<Other Steps>

The washed toner particles subjected to drying. Sequentially, the toner particles are optionally subjected to a classification. The classification is, for example, carried out by cyclone, decanter, or centrifugal separation in the solution. Alternatively, the classification is carried out after the toner particles are obtained as powder by drying. The classification performed in the solution is preferable in view of production efficiency. At the time of classification in the solution, the unselected fine particles and coarse particles are placed back to the kneading step to form toner particles therefrom. Such fine particles and coarse particles may be in a wet-condition.

The thus obtained toner particles are subjected to mixing with particles such as the colorant, the releasing agent, the charge controlling agent, etc. (external additives), and mechanical impact, thereby preventing the particles such as the releasing agent falling off from the surface of the toner particles.

The toner after being mixed with the external additives may be simply referred as "toner" in the specification.

Examples of the method of imparting mechanical impact are a method in which an impact is imparted by rotating a blade at high speed, and a method in which an impact is imparted by introducing the mixed particles into a high-speed flow and accelerating the speed of the flow so as to make the particles impact with each other or so as to make the composite particles to impact upon an impact board. Examples of a device employed to such a method are an angmill (manufactured by Hosokawamicron Corp.), a modified I-type mill (manufactured by Nippon Pneumatic Mfg. Co., Ltd.) to decrease crushing air pressure, a hybridization system (manufactured by Nara Machinery Co. Ltd.), a krypton system (manufactured by Kawasaki Heavy Industries, Ltd.), an automatic mortar, and the like.

The toner is formed after drying and classifying the washed toner in the washing step.

In the method for producing a toner of the present invention, the granulated toner in the aforementioned granulating is subjected to at least washing with an alkali washing solution, and the alkali washing is carried out until a total organic carbon amount extractable from the alkali-washed toner becomes 200 ppm/g or less. Accordingly, the emulsifiers, dispersants, ionic impurities and the like are removed from the surface of the toner or the resin particles, and thus there is efficiently produced a toner having an excellent charging ability, a desirable shelf stability, and excellent low-temperature fixing properties, and attaining high quality images.

(Developer)

The toner of the present invention may be used as or contained in a developer. Such a developer further comprises other appropriately selected components such as the aforementioned carrier. The developer is either one-component developer or two-component developer. However, the two-component developer is preferable in view of improved life span when the developer is used with, for example, a high speed printer that complies with improvements in recent information processing speed.

The one-component developer using the toner of the present invention shows little changes in the average toner particle size when the toner is repeatedly supplied after consumption thereof. There is no toner filming on the developing roller or adhered by fusion to the members such as the blade for forming a thin toner layer. The one-component developer provides excellent and stable developing property and images after being used (stirred) for a long period of time of a developing device. The two-component developer using the toner of the present invention shows little changes in the average toner particle size in the developer when the toner is repeatedly supplied after consumption due to developing. Even after a long time-period of stirring in a developing device, the two-component developer provides excellent and stable developing properties.

The aforementioned carrier is not particularly limited and can be appropriately selected in accordance with a purpose. However, the carrier is preferably those having a core material and a resin layer coating the core material.

The aforementioned core material is not particularly limited and can be appropriately selected from the known materials. For example, 50 emu/g to 90 emu/g manganese-strontium (Mn—Sr) materials, manganese-magnesium (Mn—Mg) materials are preferable materials. Highly magnetizable materials such as iron powder (100 emu/g or higher) and magnetite (75 emu/g to 120 emu/g) are preferable in view of ensuring the image density. Weakly magnetizable materials such as copper-zinc (Cu—Zn) materials (30 emu/g to 80 emu/g) is preferable in view of reducing the shock to the photoconductor the toner ears from, which is advantageous for high image quality. These are used individually or in combination of two or more.

The aforementioned core material preferably has a volume average particle size of 10 μm to 150 μm, more preferably 40 to 100 μm.

In the case that the average particle size (volume average particle size ($D_{50}$) is smaller than 10 μm, an increased amount of fine powder is observed in the carrier particle size distribution, and thus magnetization per particle is lowered, which may cause the carrier to fly. In the case that the average particle size is larger than 150 μm, the specific surface area is reduced, which may cause the toner to fly. Therefore, a full color image having many solid parts may not be well reproduced particularly in the solid parts.

The aforementioned material for the resin layer is not particularly limited and can be appropriately selected from known resins in accordance with a purpose. Examples of such a material are amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and an acryl monomer, copolymer of vinylidene fluoride and vinyl fluoride, fluoroterpolymer such as terpolymer of tetrafluoroethylene, vinylidene fluoride and a non-fluoride monomer, silicone resin, and the like. These are used individually or in combination of two or more.

Examples of the aforementioned amino resin are urea-formaldehyde resin, melamine resin, benzoguanamine resin, a urea resin, polyamide resin, epoxy resin, and the like. Examples of the aforementioned polyvinyl resin are acryl resin, polymethylmetacrylate resin, polyacrylonitrile resin, polyvinyl acetate resin, polyvinyl alcohol resin, polyvinyl butyral resin, and the like. Examples of the aforementioned polystyrene resin are polystyrene resin, styrene acryl copolymer resin, and the like. Examples of the aforementioned halogenated olefin resin are polyvinyl chloride, and the like. Examples of the aforementioned polyester resin are polyethyleneterephtalate resin, polybutyleneterephtalate, and the like.

The resin layer contains, for example, conductive powder, if necessary. Examples of the conductive powder include metal powder, carbon black, titanium oxide, tin oxide, zinc oxide, and the like. The conductive power preferably has an average particle size of 1 μm or smaller. In the case that the average particle size is larger than 1 μm, it may difficult to control electronic resistance.

The resin layer is formed, for example, by dissolving the aforementioned silicone resin or the like in a solvent to prepare a coating solution, uniformly applying the coating solution to the surface of the aforementioned core material by a known technique, drying, and baking. Examples of the application technique include immersion, spray, and brushing.

The aforementioned solvent is not particularly limited and can be appropriately selected in accordance with a purpose. Examples of the solvent are toluene, xylene, methyethylketone, methylisobutylketone, cerusolbutylacetate, and the like.

Baking is not particularly restricted and can be performed by external heating or internal heating. For example, a technique using a fixed electric furnace, a flowing electric furnace, a rotary electric furnace, or a burner or a technique using a microwave can be used.

The content of the resin layer in the carrier is preferably 0.01% by mass to 5.0% by mass. In the case that it is less than 0.01% by mass, the resin layer may not be uniformly formed on the surface of the core material. In the case that it is more than 5.0% by mass, the resin layer may become excessively thick and cause the granulation between carriers, thereby uniform carrier particles may not be obtained.

When the aforementioned developer is a two-component developer, the content of the carrier in the two-component developer is not particularly limited and can be appropriately selected in accordance with a purpose. For example, the content is preferably 90% by mass to 98% by mass, and more preferably 93% by mass to 97% by mass.

The developer containing the toner of the present invention has an excellent cleaning ability and reliably forming high quality images.

The developer of the present invention can be preferably used in forming images by known, various electrophotographic techniques such as magnetic one-component developing, non-magnetic one-component developing, and two-component developing. In particular, the developer can be preferably used in the toner container, process cartridge, image-forming apparatus, and the image-forming method of the present invention below.

(Toner Container)

The toner container comprises a container and the toner or the developer of the present invention filled in the container.

The container is not particularly limited and can be appropriately selected from known containers. Preferable examples of the container include one having a toner container body and a cap.

The toner container body is not particularly limited in size, shape, structure, and material and can be appropriately selected in accordance with a purpose. The shape is preferably a cylinder. It is particularly preferable that a spiral ridge is formed on the inner surface, thereby the content or the toner moves toward the discharging end when rotated and the spiral part partly or entirely serves as a bellows.

The material of the toner container body is not particularly limited and preferably offers dimensional accuracy. For example, resins are preferable. Among these, polyester resin, polyethylene resin, polypropylene resin, polystyrene resin, polyvinyl chloride resin, polyacrylic acid, polycarbonate resin, ABS resin, polyacetal resin are preferable.

The toner container is easy to preserve and ship, is handy, and is preferably used with the process cartridge and image forming apparatus, which are described later, by detachably mounting therein for supplying toner.

(Process Cartridge)

The process cartridge comprises a latent electrostatic image bearing member which is configured to bear a latent electrostatic image thereon, and a developing unit which is configured to develop the latent electrostatic image with a developer to form a visible image. The process cartridge further comprises other units or members, if necessary.

The developing unit has a developer storage for storing the aforementioned toner or developer of the present invention and a developer bearing member which is configured to bear and transfer the toner or developer stored in the developer storage and may further have a layer thickness control member for controlling the thickness of a toner layer formed on the developer bearing member.

The process cartridge can be detachably mounted in a variety of electrophotographic apparatus and preferably detachably mounted in the electrophotographic apparatus of the present invention, which is described later.

(Image-Forming Method and Image-Forming Apparatus)

The image-forming method of the present invention comprises a latent electrostatic image formation, developing, transferring, and fixing. The image-forming method of the present invention optionally comprises other steps, such as charge removal, cleaning, recycling, and the like.

The image-forming apparatus comprises a latent electrostatic image bearing member, a latent electrostatic image forming unit, a developing unit, a transferring unit, and the fixing unit. The image-forming apparatus optionally comprises other units or members such as a charge removing unit, a cleaning unit, a recycling unit, and a controlling unit.

—Latent Electrostatic Image Formation and Latent Electrostatic Image Forming Unit—

The latent electrostatic image formation is a step for forming a latent electrostatic image on a latent electrostatic image bearing member.

Note that, in the present specification, the latent electrostatic image bearing member is also referred to a photoconductive insulator, or a photoconductor.

The latent electrostatic image bearing member is not particularly limited in the material, shape, structure or size thereof, and can be appropriately selected from the conventional members. A suitable example of the shape thereof is a drum shape. Examples of the material thereof are an inorganic photoconductor such as amorphous silicone, or selenium, an organic photoconductor such as polysilane, or phthalopolymethine, and the like. Among these examples, the amorphous silicone is preferable in view of long lifetime.

The latent electrostatic image formation is carried out, for example, by exposing the latent electrostatic image bearing member to imagewise light after uniformly charging the entire surface of the latent electrostatic image bearing member. This is performed by means of the latent electrostatic image forming unit.

The latent electrostatic image forming unit comprises a charging unit which is configured to uniformly charge the surface of the photoconductor, and an exposing unit which is configured to expose the surface of the latent electrostatic image bearing member to imagewise light.

The charging is carried out, for example, by applying voltage to the surface of the photoconductor by means of the charging unit.

The charging unit is not particularly limited, and can be appropriately selected in accordance with a purpose. Examples of the charging unit are the conventional contact-charging unit equipped with a conductive or semiconductive roller, blush, film, or rubber blade, the conventional non-contact-charging unit utilizing corona discharge such as corotron, or scorotoron, and the like.

The exposure is carried out, for example, by exposing the surface of the latent electrostatic image bearing member to imagewise light by means of the exposing unit.

The exposing unit is not particularly limited, provided that a predetermined exposure is performed imagewise on the surface of the charged latent electrostatic image bearing member by the charging unit, and can be appropriately selected in accordance with a purpose. Examples of the irradiating unit are various irradiating units such as an optical copy unit, a rod-lens-eye unit, an optical laser unit, an optical liquid crystal shatter unit, and the like In the present invention, a backlight system may be applied for the exposure, in which exposure is carried out imagewise from the back side of the latent electrostatic image bearing member.

—Developing and Developing Unit—

The developing is a step of developing the latent electrostatic image with the toner to form a visible image (toner image).

The developing is performed, for example, by developing the latent electrostatic image with the toner or developer of the present invention by means of the developing unit.

The developing unit is not particularly limited, provided that developing is carried out with the toner or developer of the present invention, and can be appropriately selected in accordance with a purpose. A suitable example of the developing unit is a developing unit which contains the toner or developer therein and capable of directly or indirectly applying the toner to the latent electrostatic image. It is preferred that such a developing unit is equipped with the aforementioned toner container.

The developing unit may is of dry developing or wet developing, and for mono-color or a developing unit for multicolor. A suitable example of the developing unit is a developing unit comprising a stirring unit which stirs the toner to impart frictional electrification, and a magnet roller which is rotatably mounted.

Within the developing unit, the toner and carrier are mixed and stirred, and the toner is charged at the time of friction with the carrier, the rotatable magnetic roller bears the charged toner on the surface thereof to form a magnetic blush. Since the magnet roller is disposed adjacent to the photoconductor, a part of the toner consisting of the magnetic blush, which is formed on the surface of the magnetic roller, is electrically attracted and transferred to the surface of the photoconductor. As a result, the latent electrostatic image is developed by the toner, and the visible image (toner image) of the toner is formed on the photoconductor.

The developer contained in the developing unit is a developer comprising the aforementioned toner. The developer is either one-component developer or two-component developer.

—Transferring and Transferring Unit—

The transferring is a step of transferring the visible image onto a recording medium. The preferably embodiment of the transfer is such that a visible image is primary transferred to an intermediate transferring member, the visible image transferred on the intermediate transferring member is secondary transferred to a recording member. The more preferably embodiment of the transfer is such that the toner is of two or more color, or preferably full-color toner, and the transferring contains a primary transfer wherein a visible image is transferred to the intermediate transferring member to form a composite transferred image, and a secondary transfer wherein the composite transferred image is transferred onto a recording member.

The transfer is carried out, for example, by charging the visible image on the photoconductor by means of a transfer charging unit. This transfer is performed by means of the transferring unit. The preferable embodiment of the transferring unit is such that a transferring unit comprises a primary transferring unit which is configured to transfer a visible image onto an intermediate transferring member to form a composite transferred image, and a secondary transferring unit which is configured to transfer the composite transferred image onto a recording medium.

The intermediate transferring member is not particularly limited, and can be selected from the conventional transferring members in accordance with a purpose. Examples thereof are a transferring belt, and the like.

The transferring unit (the primary transferring unit and the secondary transferring unit) preferably comprises a transferring element which is configured to charge so as to separate the toner image from the photoconductor and to transfer onto a recording medium. In the image-forming apparatus of the present invention, either one, or plurality of transferring units are disposed.

Examples of the transferring element are a corona transferring element utilizing corona discharge, a transferring belt, a transferring roller, a pressure-transferring roller, an adhesion-transferring element, and the like.

The recording medium is not particularly limited, and can be appropriately selected from the conventional recording mediums (recording paper) in accordance with a purpose.

—Fixing and Fixing Unit—

The fixing is a step of fixing the transferred visible image onto the recording member by means of the fixing unit. The fixing may be performed every time each color of the toner is transferred to the recording medium, or after all colors of the toner are transferred and form a superimposed layer of the toner on the recording medium.

The fixing unit is not particularly limited, and can be appropriately selected in accordance with a purpose. Examples of the fixing unit are heating-pressurizing unit, and the like. The heating-pressurizing unit is preferably a combination of a heating roller and a pressurizing roller, a combination of a heating roller, a pressurizing roller, and an endless belt, and the like.

The heating by means of the heating-pressurizing unit is preferably performed at 80° C. to 200° C.

The conventional optical fixing unit may be used in addition to or instead of the aforementioned fixing and fixing unit, if necessary.

The charge removing is a step of applying a bias to the charged photoconductor so as to remove the charge. This is suitably performed by the charge removing unit.

The charge removing unit is not particularly limited, provided that bias is applied to the charged photoconductor to thereby remove the charge, and can be appropriately selected from the conventional charge removing units in accordance with a purpose. A suitable example thereof is a charge removing lamp.

The cleaning is a step of removing the residual toner on the photoconductor. This is suitably performed by means of the cleaning unit.

The cleaning unit is not particularly limited, provided that the residual toner on the photoconductor is removed, and can be appropriately selected from the conventional cleaners in accordance with a purpose. Examples thereof are a magnetic blush cleaner, a electrostatic brush cleaner, a magnetic roller cleaner, a blade cleaner, a blush cleaner, a wave cleaner, and the like.

The recycling is a step of recycling or recovering the color toner collected by the cleaning to the developing unit. This is suitably performed by means of the recycling unit.

The recycling unit is not particularly limited, and can be appropriately selected from the conventional conveyance systems.

The controlling is a step of controlling each of the aforementioned steps. This is suitably performed by means of the controlling unit.

The controlling unit is not particularly limited, provided that each of the aforementioned units or members is controlled, and can be appropriately selected in accordance with a purpose. Examples thereof are devices such a sequencer, a computer, and the like.

One embodiment of the image-forming method of the present invention by means of the image-forming apparatus of the present invention is explained with reference to FIG. 1.

The image-forming apparatus 100 shown in FIG. 1 comprises a photoconductor drum 10 (referred to a photoconductor 10 hereinafter) as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge removing lamp 70 as the charge removing unit.

The intermediate transferring member 50 is an endless belt, and looped around three rollers 51 which are disposed inside thereof. The intermediate transferring member 50 is configured to rotate in the direction shown with the arrow by means of the rollers 51. One or more of the three rollers 51 also functions as a transfer bias roller which is capable of applying a certain transfer bias (primary bias) to the intermediate transferring member 50. Adjacent to the intermediate transferring member 50, there are disposed a cleaning device 90 having a cleaning blade, and a transferring roller 80 as the transferring unit which is capable of applying a transfer bias so as to transfer (secondary transfer) a developed image (toner image) to a transfer sheet 95 as the recording medium. Moreover, there is disposed a corona charger 58 for applying a charge to the toner image transferred on the intermediate transferring medium 50, beside the intermediate transferring medium 50, and in between the contact region of the photoconductor 10 and the intermediate transferring medium 50 and the contact region of the intermediate transferring medium 50 and the transfer sheet 95 in the rotational direction of the intermediate transferring medium 50.

The developing device 40 comprises a developing belt 41, a black developing unit 45K, yellow developing unit 45Y, magenta developing unit 45M, and cyan developing unit 45C, in which the developing units positioned around the developing belt 41. The black developing unit 45K comprises a developer container 42K, a developer supplying roller 43K, and a developing roller 44K; the yellow developing unit 45Y comprises a developer container 42Y, a developer supplying roller 43Y, and a developing roller 44Y; the magenta developing unit 45M comprises a developer container 42M, a developer supplying roller 43M, and a developing roller 44M; the cyan developing unit 45C comprises a developer container 42C, a developer supplying roller 43C, and a developing roller 44C. In addition, the developing belt 41 is an endless belt which is looped around a plurality of belt rollers so as to rotate. Moreover, the developing belt 41 is configured to contact with the photoconductor 10 at a part thereof.

In the image-forming apparatus 100 shown in FIG. 1, the photoconductor 10 is uniformly charged by the charging roller 20. The exposure device 30 sequentially exposes the photoconductor 10 to imagewise light so as to form a latent electrostatic image. The latent electrostatic image formed on the photoconductor 10 is supplied with a toner from the developing device 40 so as to form a visible image (toner image). The roller 51 applies a bias to the visible image (toner image) so as to transfer (primary transfer) the toner image onto the intermediate transferring medium 50, and further applies a bias to transfer (secondary transfer) the toner image from the intermediate transferring medium 50 to the transfer sheet 95. In this way, the transferred image is formed on the transfer sheet 95. Thereafter, the residual toner on the photoconductor 10 is removed by the cleaning device 60, and the charged photoconductor 10 is diselectrified by the charge removing lamp 70.

Another embodiment of the image-forming method of the present invention by means of the image-forming apparatus of the present invention is explained with reference to FIG. 2.

Figure 2:
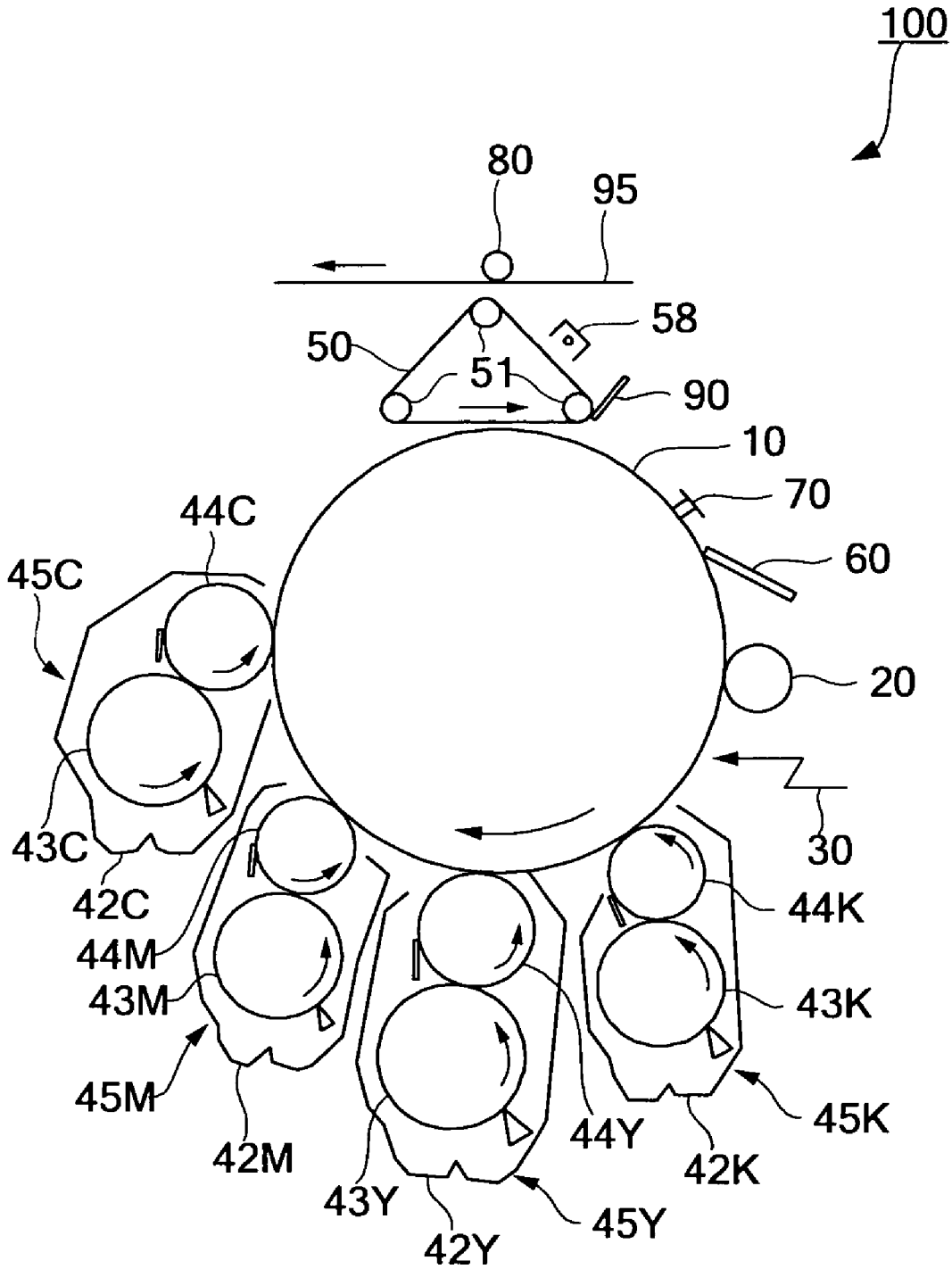
FIG. 2 is a schematic diagram to show another exemplary embodiment of an image-forming method according to the present invention with assistance of an image-forming apparatus.
Figure 4:
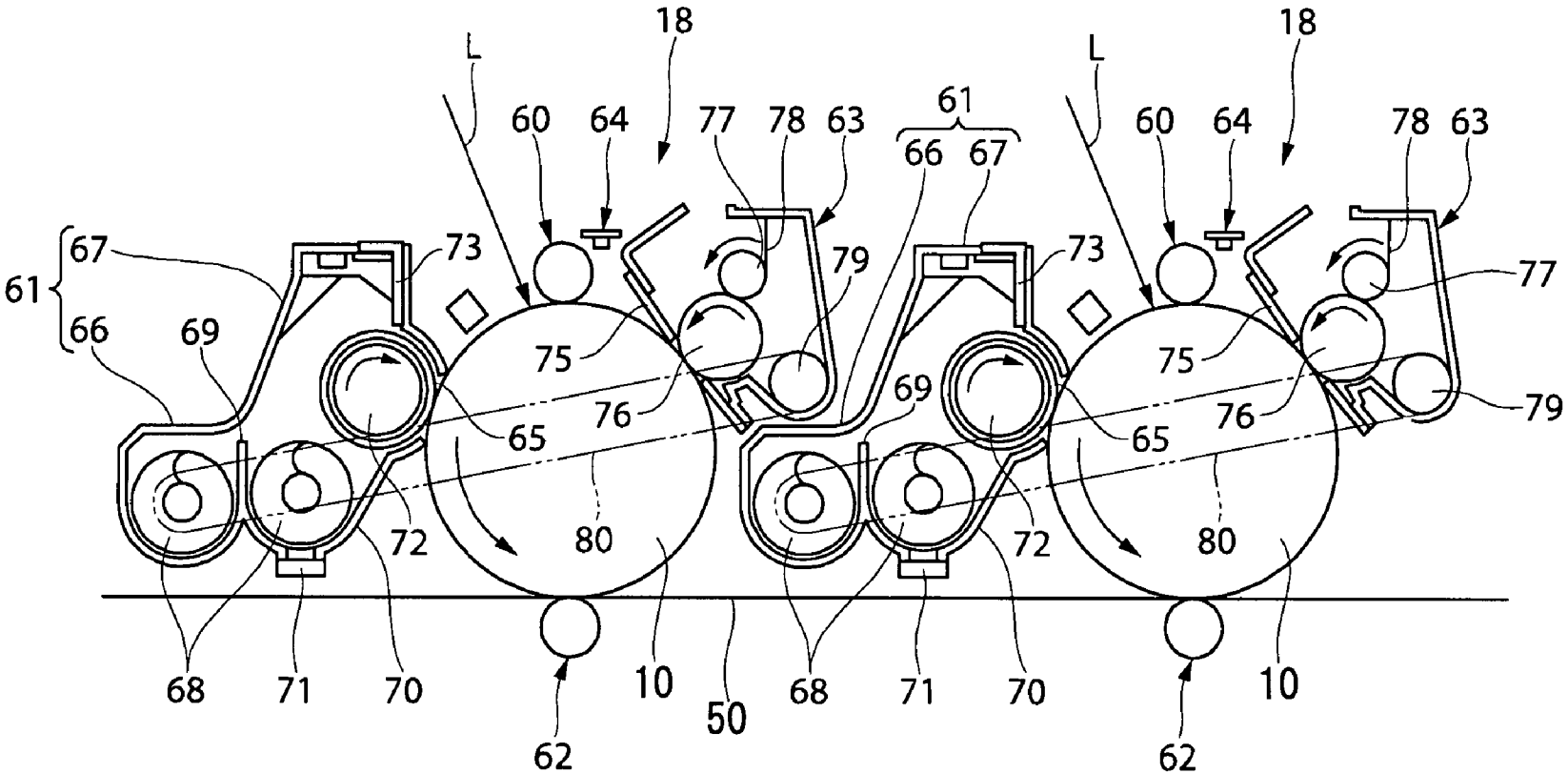
FIG. 4 is a schematic diagram to show an enlarged view of a part of the image-forming apparatus illustrated in FIG. 3.
Figure 5:
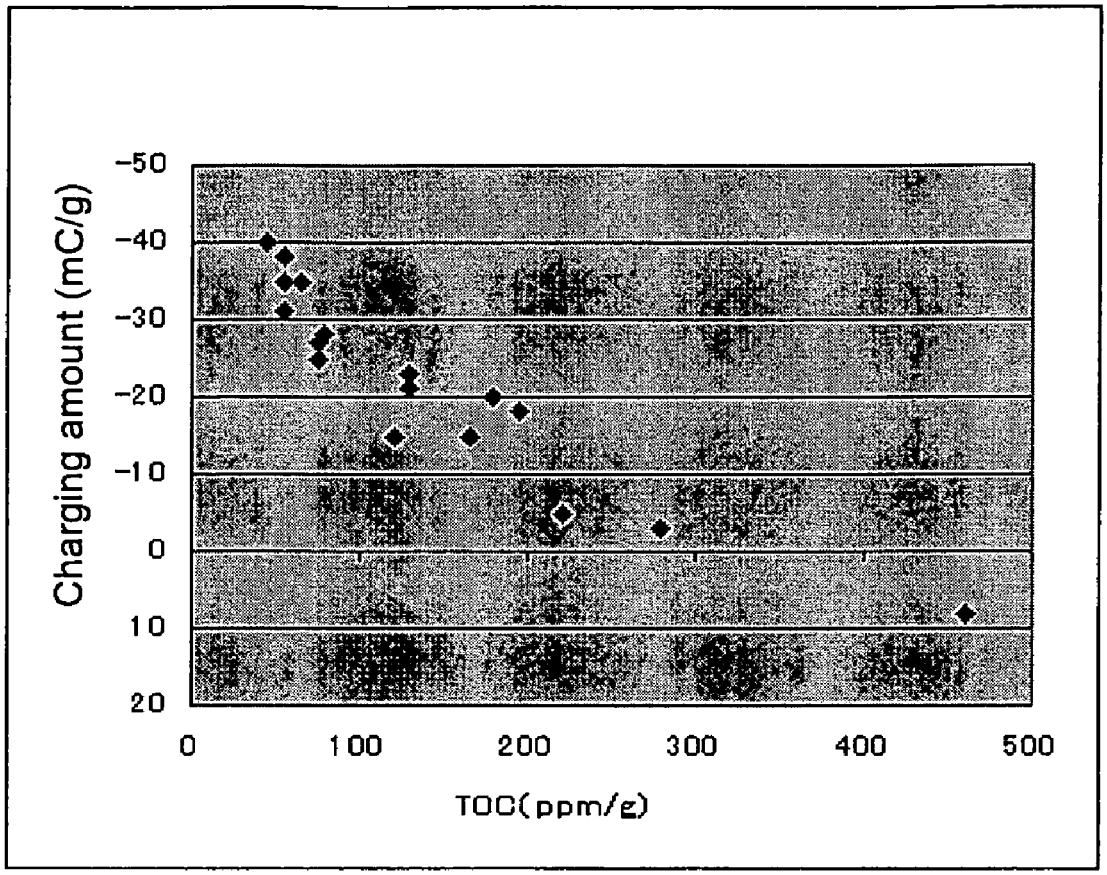
FIG. 5 is a graph to show an exemplary relationship between the extracted TOC amount from the alkali-washed toner and charging amount (charge-raising ability).

The image-forming apparatus 100 shown in FIG. 2 has the identical configurations and functions to the image-forming apparatus 100 shown in FIG. 1, provided that the image-forming apparatus 100 does not comprise a developing belt 41, and the black developing unit 45K, the yellow developing unit 45Y, the magenta developing unit 45M, and the cyan developing unit 45C are disposed around the photoconductor 10 so as to face to each other. Note that, the reference numbers of FIG. 5 denote the same members or units to the ones in FIG. 4, if the numbers are identical.

Another embodiment of the image-forming method of the present invention by means of the image-forming apparatus of the present invention is explained with reference to FIG. 3.

Figure 3:
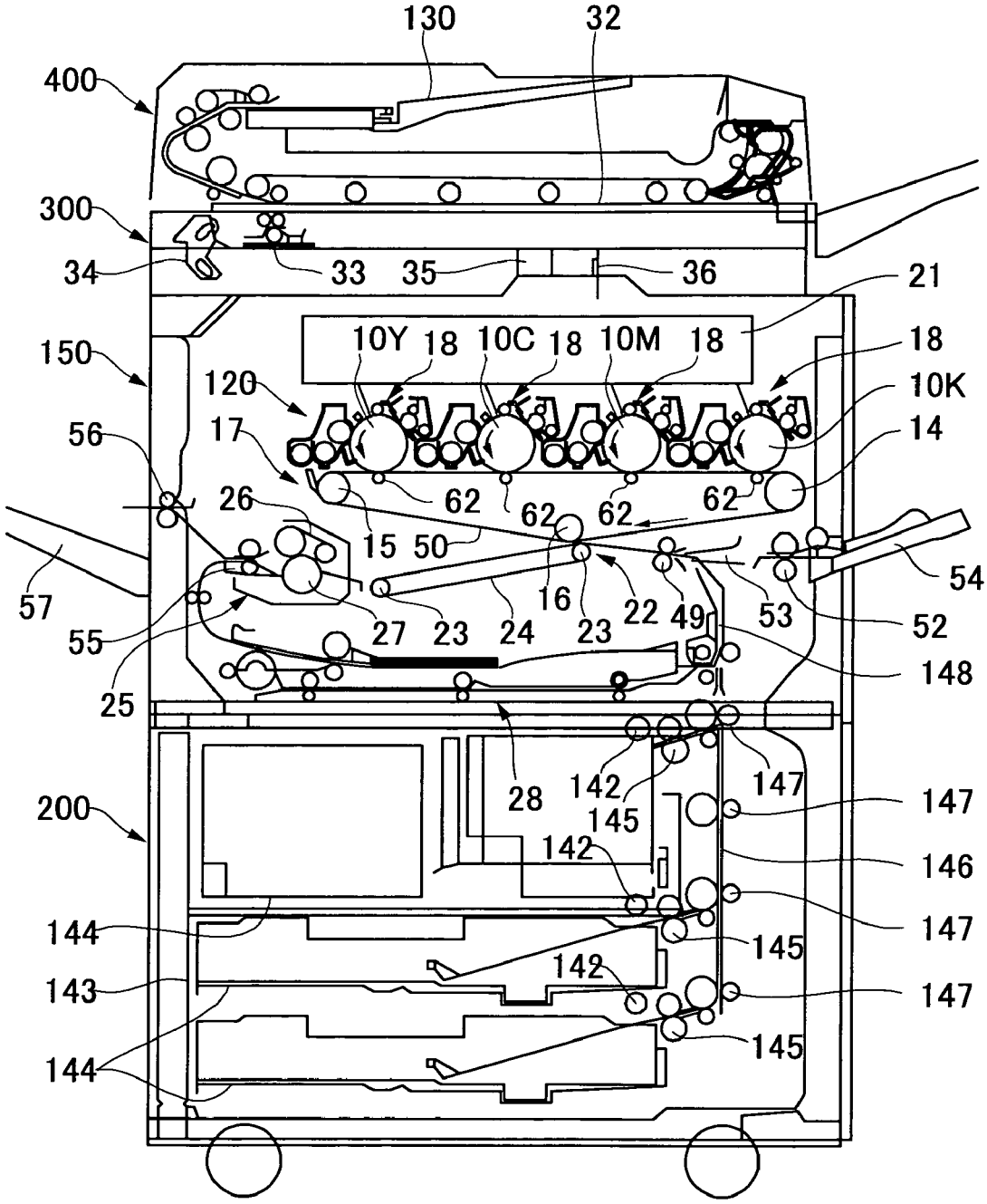
FIG. 3 is a schematic diagram to show an exemplary embodiment of an image-forming method according to the present invention with assistance of an image-forming apparatus (tandem-type color-image-forming apparatus).

The tandem image-forming apparatus 100 shown in FIG. 3 is a tandem color-image-forming apparatus. The tandem image-forming apparatus 100 comprises a copying machine main body 150, a feeder table 200, a scanner 300, and an automatic document feeder (ADF) 400. The copying machine main body 150 contains an endless-belt intermediate transferring member 50.

The intermediate transferring member 50 shown in FIG. 6 is looped around support rollers 514, 515 and 516 and is configured to rotate in a clockwise direction in FIG. 6.

There is disposed a cleaning device 17 for the intermediate transferring member adjacent to the support roller 15. The cleaning device 17 for the intermediate transferring member is capable of removing a residual toner on the intermediate transferring member 50 after transferring a toner image.

Above the intermediate transferring member 50 looped around the support rollers 514 and 515, four image-forming devices 18 of yellow, cyan, magenta, and black are arrayed in parallel in a conveyance direction of the intermediate transferring member 50 to thereby constitute a tandem developing unit 120.

There is also disposed an exposing unit 21 adjacent to the tandem developing unit 120. A secondary transferring unit 22 is disposed the opposite side of the intermediate transferring member 50 to where the tandem developing unit 120 is disposed. The secondary transferring unit 22 comprises a secondary transferring belt 24 of an endless belt, which is looped around a pair of rollers 23. The secondary transferring unit 22 is configured so that the transfer sheet conveyed on the secondary transferring belt 24 contacts with the intermediate transferring member 50. Adjacent to the secondary transferring unit 22, there is disposed an image-fixing device 25. The image-fixing device 25 comprises a fixing belt 26 which is an endless belt, and a pressurizing roller 27 which is disposed so as to contact against the fixing belt 26.

In the tandem image-forming apparatus 100, a sheet reverser 28 is disposed adjacent to the secondary transferring unit 22 and the image-fixing device 25. The sheet reverser 28 is configured to reverse a transfer sheet in order to form images on the both sides of the transfer sheet.

Next, full-color image-formation (color copy) is formed by means of the tandem developing unit 120 in the following manner.

Initially, a document is placed on a document platen 130 of the automatic document feeder 400. Alternatively, the automatic document feeder 400 is opened, the document is placed on a contact glass 32 of the scanner 300, and the automatic document feeder 400 is closed to press the document.

At the time of pushing a start switch (not shown), the document placed on the automatic document feeder 400 is transported onto the contact glass 32. In the case that the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the color document (color image). The read color image is interrupted to image information of black, yellow, magenta and cyan.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 7, there are disposed a photoconductor 10 (a photoconductor for black 10K, a photoconductor for yellow 10Y, a photoconductor for magenta 10M, or a photoconductor for cyan 10C), a charger 60 which uniformly charge the photoconductor, an exposure unit (L) which form a latent electrostatic image corresponding to each color image on the photoconductor, an developing unit 61 which develops the latent electrostatic image with the corresponding color toner (a black toner, a yellow toner, a magenta toner, or a cyan toner) to form a toner image of each color, a transfer charger 62 for transferring the toner image to the intermediate transferring member 50, a photoconductor cleaning device 63, and a charge removing unit 64. Accordingly, each mono-color images (a black image, a yellow image, a magenta image, and a cyan image) are formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transferring member 40 which rotate by means of support rollers 14, 15 and 16. These toner images are superimposed on the intermediate transferring member 40 to form a composite color image (color transferred image).

One of feeder rollers 142 of the feeder table 200 is selectively rotated, sheets are ejected from one of multiple feeder cassettes 144 in a paper bank 143 and are separated in a separation roller 145 one by one into a feeder path 146, are transported by a transport roller 147 into a feeder path 148 in the copying machine main body 100 and are bumped against a resist roller 149. Alternatively, one of the feeder rollers 142 is rotated to ejected sheets from a manual-feeding tray 54, and the sheets are separated in a separation roller 52 one by one into a feeder path 53, transported one by one and then bumped against the resist roller 49. Note that, the resist roller 49 is generally earthed, but it may be biased for removing paper dust of the sheets.

The resist roller 49 is rotated synchronously with the movement of the composite color image on the intermediate transferring member 50 to transport the sheet (recording medium) into between the intermediate transferring member 50 and the secondary transferring unit 22, and the composite color image is transferred onto the sheet by action of the secondary transferring unit 22. After transferring the toner image, the residual toner on the intermediate transferring member 50 is cleaned by means of the intermediate cleaning device 17.

The sheet bearing the transferred image is transported by the secondary transferring unit 22 into the image-fixing device 25, is applied with heat and pressure in the image-fixing device 25 to fix the composite color image (transferred image) to the sheet (recording medium).

The sheet (recording medium) is ejected to the side of the pressurizing roller 27. Thereafter, the sheet changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

The image-forming method of the present invention and the image-forming apparatus efficiently produce high quality images as the toner of the present invention, which has a small particle size and is suitably deformed, is used.

The synthesis and production examples are presented hereinafter, but these examples do not intend to limit the scope or embodiment of the present invention. Note that all parts and % described hereinafter are mass based, unless mentioned otherwise.

Synthesis Example 1

Synthesis of Crystalline Polyester 1

Into a 5 liter four necked flask equipped with a nitrogen gas feed tube, a dewatering tube, a stirrer and a thermocouple, were poured 2,070 g of 1,4-butane diol, 2,535 g of fumaric acid, 291 g of trimellitic anhydride, and 4.9 g of hydroquinone, and the mixture was allowed to react at 160° C. for 5 hours, at 200° C. for 1 hour, and at 8.3 kPa for 1 hours, to thereby yield Crystalline Polyester 1.

The thus obtained Crystalline Polyester 1 had a melting point of 128° C., DSC endothermic peak temperature of 130° C., a number average molecular mass (Mn) of 900, mass average molecular mass (Mw) of 3,500, and a ratio Mw/Mn of 3.89. Note that Mn and Mw were obtained in terms of a molecular mass distribution of a tetrahydrofuran (THF) soluble part measured by means of gel permeation chromatography (GPC). The infrared spectrograph of the Crystalline Polyester 1 had an absorption band based on 6 CH (out-of-plane deformation vibration) of olefin of 970 $cm^{-1}$. The properties of Crystalline Polyester 1 are summarized in Table 1.

Synthesis Examples 2-6

Synthesis of Crystalline Polyesters 2-6

Crystalline Polyesters 2-6 of Synthesis Examples 2-6 were synthesized in the same manner as Synthesis Example 1, provided that the usage amount of the acid components were changed as in Table 1. The properties of the thus obtained crystalline polyesters are summarized in Table 1.

TABLE 1

| Synthesis Example | acid component (g) fumaric acid | maleic acid | trimellitic anhydrate | Tm. (° C.) | DC emdothermic peak (° C.) | Mw | Mn | Mw/Mn | δCH ($cm^{-1}$) |
|---|---|---|---|---|---|---|---|---|---|
| 1 | 2282 | 254 | 291 | 128 | 130 | 3,500 | 900 | 3.89 | 970 |
| 2 | 2535 | 0 | 291 | 139 | 140 | 2,800 | 800 | 3.50 | 968 |
| 3 | 2028 | 508 | 291 | 113 | 119 | 3,300 | 700 | 4.71 | 970 |
| 4 | 1775 | 762 | 291 | 94 | 100 | 1,500 | 800 | 1.88 | 970 |
| 5 | 1775 | 762 | 582 | 91 | 99 | 11,900 | 2,400 | 4.96 | 999 |
| 6 | 1268 | 1268 | 582 | 55 | 53 | 9,735 | 3,425 | 2.84 | 961 |

Production Example 1

Preparation of Crystalline Polyester Dispersion 1

Into 2 L metal contained were poured 100 g of Crystalline Polyester 4 of Synthesis Example 4 and 400 g of ethyl acetate, and the mixture was dissolved by heating at 79° C. (Tm) and then cooled in iced water. The resultant was added with 500 ml of glass beads having a diameter of 3 mm and crashed by means of Batch-type Sand Mill (manufactured by Kanpe Hapio Co., Ltd.) for 10 hours, and ethyl acetate was partially removed to thereby Crystalline Polyester Dispersion 1 having an volume average particle diameter (Dv) of 0.4 μm, and a solid content of 50%.

Production Examples 2-6

Preparation of Crystalline Polyester Dispersions 2-6

Crystalline Polyester Dispersions 2-6 of Production Examples 2-6 were prepared in the same manner as Production Example 1, provided that the conditions for dispersion were changed as presented in Table 2.

TABLE 2

| Crystalline Polyester Production Ex. | Synthesis Ex. | Organic solvent | Crushing Tm (° C.) | time (hr) | Dv (μm) |
|---|---|---|---|---|---|
| 1 | 4 | ethyl acetate | 79 | 10 | 0.4 |
| 2 | 1 | methylethyl ketone | 80 | 30 | 0.7 |
| 3 | 2 | toluene | 110 | 60 | 0.9 |
| 4 | 3 | ethyl acetate | 79 | 45 | 0.6 |
| 5 | 5 | ethyl acetate | 79 | 18 | 0.4 |
| 6 | 6 | ethyl acetate | 79 | 8 | 0.3 |

The examples of the present invention are explained hereinafter, but theses are not intend to limit the present invention.

Example 1

Formation of Toner Particles

A toner was produced while generating an adhesive-base material as follow.

—Preparation of Organic Solvent Phase—

——Preparation of Unmodified (Lower Molecular Mass) Polyester——

Into a reactor equipped with a condenser, a stirrer, and a nitrogen gas feed tube were poured 220 parts of ethylene oxide (2 mole) adduct of bisphenol A, 529 parts of propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. Thereafter, the reaction mixture was further reacted with 44 parts of trimellitic anhydride at 180° C. at normal atmospheric pressure for 2 hours, to thereby yield unmodified polyester. The thus obtained unmodified polyester had a number-average molecular mass (Mn) of 2,500, a mass-average molecular mass (Mw) of 6,700, a glass transition temperature (Tg) of 43° C., and an acid value of 25 mg KOH/g.

—Preparation of Master Batch——

1,200 parts of water, 540 parts of carbon black (PB-k7: Printex 60, manufactured by Degussa; DBP absorption amount: 114 ml/100 g; pH 7) as a colorant, and 1200 parts of a polyester resin (RS801, manufactured by Sanyo Chemical Industries Co., acid value: 10 mg KOH/g, Mw: 20,000, Tg: 64° C.) were mixed by means of Henschel Mixer (manufactured by Mitsui Mining Co.). The mixture was kneaded at 150° C. for 30 minutes by a two-roller mill, cold-rolled, and milled into a diameter of 1 mm order by a pulverizer (manufactured by Hosokawamicron Corp.), to thereby yield a master batch.

Into a reactor equipped with a stirring rod and a thermometer were poured 378 parts of the previously-obtained unmodified polyester, 92 parts of carnauba wax, 22 parts of CCA (a salicylic acid metal complrex manufactured by Orient Chemical Industries, Ltd.), and 947 parts of ethylacetate. The mixture was heated at 80° C. for 5 hours with stirring and was then cooled to 30° C. over 1 hour. The mixture was further treated with 500 parts of the previously-obtained master batch and 500 parts of ethylacetate with stirring for 1 hour, to thereby yield a material solution.

Thereafter, 1324 parts of the material solution was poured into a vessel, and the carbon black and the carnauba wax therein were dispersed using a bead mill (Ultravisco-Mill, by Aimex Co.) at a liquid feeding speed of 1 kg/hr, a disc rotation velocity of 6 m/sec, using zirconia beads 0.5 mm in diameter filled 80% by volume. The dispersing procedure was repeated three times. The dispersion was further treated with 1042.3 parts of 65% ethylacetate solution of the unmodified polyester, and the mixture was dispersed under the above conditions except that the dispersion procedure was repeated once to yield Organic Solvent Phase 1. The thus obtained Organic Solvent Phase had a solid content of 50% as determined by heating to 130° C. for 30 minutes.

—Preparation of Oil Phase Mixture—

——Synthesis of Prepolymer——

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 8 hours, was further reacted under a reduced pressure of 10 mmHg to 15 mmHg for 5 hours, and thereby yielded an intermediate product of polyester. The thus obtained intermediate product had a number-average molecular mass (Mn) of 2,100, a mass-average molecular mass (Mw) of 9,500, a glass transition temperature (Tg) of 55° C., an acid value of 0.5 mg KOH/g, and a hydroxyl value of 51 mg KOH/g.

Then, into a reactor equipped with a condenser, a stirrer, and a nitrogen gas feed tube were poured 410 parts of the previously-obtained intermediate product, 89 parts of isophorone diisocyanate, and 500 parts of ethylacetate, followed by reaction at 100° C. for 5 hours to thereby yield a prepolymer (polymer capable of reacting with the active hydrogen group-containing compound). The thus obtained prepolymer had a free isocyanate content of 1.53%.

——Synthesis of Ketimine (the Active Hydrogen Group-Containing Compound)——

Into a reactor equipped with a stirring rod and a thermometer were poured 170 parts of isophoronediamine and 75 parts of methylethylketone, followed by reaction at 50° C. for 5 hours to thereby yield a ketimine compound (the active hydrogen group-containing compound). The thus obtained ketimine compound (the active hydrogen group-containing compound) had an amine value of 418 mg KOH/g.

Into a reactor were poured 664 parts of the organic solvent phase, 109.4 parts of the prepolymer, and 4.6 parts of the ketimine compound. The mixture was mixed at 5,000 rpm for 1 minute using a TK Homo Mixer (by Tokushu Kika Kogyo Co.), to thereby yielded an oil phase mixture.

—Preparation of Aqueous Medium Phase—

——Preparation of Particle Dispersion——

Into a reactor equipped with a stirring rod and a thermometer were poured 683 parts of water, 11 parts of sodium salt of sulfuric acid ester of ethylene oxide adduct of methacrylic acid (Eleminol RS-30 manufactured by Sanyo Chemical Industries Co.), 83 parts of styrene, 83 parts of methacrylic acid, 110 parts of butyl acrylate, and 1 part of ammonium persulfate, and the mixture was then stirred at 400 rpm for 15 minutes to thereby yield a white emulsion. The emulsion was heated to 75° C. and was allowed to react for 4 hours. The reaction mixture was further treated with 30 parts of a 1% aqueous solution of ammonium persulfate, was aged at 75° C. for 5 hours, to thereby yield an aqueous dispersion (particle dispersion) of vinyl resin (a copolymer of methacrylic acid-butyl acrylate-sodium salt of sulfate of methacrylic acid-ethylene oxide adduct), i.e. a fine-particle dispersion. The dispersed particles in the thus obtained particle dispersion had a volume-average particle diameter of 105 nm by the laser scattering particle size distribution analyzer (LA-920 manufactured by Horiba, Ltd.). A part of the particle dispersion was dried to isolate the resin component. The resin component had a glass transition temperature (Tg) of 59° C. and a mass-average molecular mass (Mw) of 150,000.

An opaque liquid (aqueous medium phase) was prepared by blending and stirring 990 parts of water, 83 parts of the previously-obtained particle dispersion, 37 parts of 48.5% aqueous solution of sodium dodecyldiphenylether disulfonate (Eleminol MON-7 manufactured by Sanyo Chemical Industries, Ltd.), and 90 parts of ethylacetate.

—Emulsification and Dispersion—

Into a reactor were poured 809 parts of the organic solvent phase and 1,200 parts of the aqueous medium phase, and the mixture was mixed at 13,000 rpm for 20 minutes using TK Homo Mixer (by Tokushu Kika Kogyo Co.), to thereby yield an emulsified slurry.

Into a reactor equipped with a stirring rod and a thermometer were poured the emulsified slurry, and was heated at 30° C. for 8 hour to remove the solvents. The slurry was then aged at 40° C. for 4 hours, to thereby yield Dispersed Slurry 1.

The thus obtained Dispersed Slurry 1 had a volume average particle diameter of 5.00 μm and number average particle diameter of 4.50 μm by the measurement of MultiSizer II (manufactured by Beckmann Coulter Inc.).

<Washing>

100 parts of the previously-obtained dispersed slurry was filtered under a reduced pressure. Thereafter, the filtered cake was mixed with 300 parts of deionized water at 12,000 rpm for 10 minutes using TK Homo Mixer, and then filtered to thereby yield slurry. The obtained toner (slurry) had a glass transition temperature (Tg) of 43° C.

—Alkali Washing (1)—

To the slurry was added 10% of sodium hydroxide aqueous solution while stirring so that pH of the solution became 10.5 at 25° C. for 2 hours. Thereafter, the solution was subjected to solid-liquid separation by means of a decanter, and filtered under reduced pressure thereby to yield a filtered cake.

The total organic carbon (TOC) amount extractable from the filtered cake was measured by means of TOC analyzer, TOC-5000A, manufactured by Shimadzu Corporation, in the following manner.

The obtained filtered cake was dried and measured of the solid content. 7.5 g of the filtered cake was precisely weighted in a 140 ml bottle (S1). To the bottle was added 47.5 g of KOH aqueous solution of pH 9 (S2). Ultrasonic was imparted to the mixture at 30° C. or lower for 30 minutes, and about 1.5 ml of the mixture was subjected to centrifugal separation in a microtube. The supernatant of the separated mixture was filtered by 0.2 μm microfilter so as to remove fine particles, and the rest of the supernatant was poured back to the microtube. The filter was washed by tap-water and then by pure water, and then the depositions of the separated mixture were filtered by 1 μm microfilter. To the obtained filtrate were added two drops of HCl (35% by mass) aqueous solution, and pH of the mixed solution was confirmed to be 3 or less. The obtained mixed solution was precisely weighted (T1), and added and diluted with pure water so that the total weight to be 6.0 mg. Thereafter, the diluted solution precisely weighted (T2). The thus obtained solution is heated at 680° C. so as to generate the carbon in the organic substances in the solution as carbonic acid gas, and the extracted TOC amount was measured by analyzing the carbonic acid gas by infrared spectroscopy. The TOC amount can be calculated by the following equation.

$$\text{TOC (ppm/g)} = \text{TOC measurement} \times (S1+S2)/\{S1 \times (\text{Solid content (mass \%)}/100)\} \times T2/T1) \quad \text{<Equation>}$$

It was found that the extracted TOC amount was 180 ppm/g. The result is shown in Table 6.

—Water Washing (1)—

The thus obtained filtered cake by the alkali washing (1) was added with 300 parts of dionized water at 12,000 rpm for 10 minutes using TK Homo Mixer, and then filtered. This procedure was repeated until the conductivity of the dionized water after washing became 20 μS/cm to thereby yield a filtered cake.

—Acid Washing—

The thus obtained filtered cake by the water washing (1) was added with 300 parts of dionized water at 12,000 rpm for 10 minutes using TK Homo Mixer to thereby yield slurry. To the slurry was added 10% hydrochloric acid aqueous solution so that pH of the solution became 3.0 at 25° C. for 30 minutes. Thereafter, the mixture was filtered to thereby yield a filtered cake.

—Water Washing (2)—

The thus obtained filtered cake by the acid washing was added with 300 parts of dionized water at 12,000 rpm for 10 minutes using TK Homo Mixer, and then filtered. This procedure was repeated until the conductivity of the dionized water after washing became 10 μS/cm to thereby yield a filtered cake.

The thus obtained filtered cake by the water washing (2) was added with 300 parts of dionized water at 12,000 rpm for 10 minutes using TK Homo Mixer, and then filtered to thereby yield slurry. To the thus obtained slurry was added 10% of sodium hydroxide aqueous solution while stirring so that pH of the solution became 7.0 at 25° C. for 2 hours. Thereafter, the solution was subjected to solid-liquid separation by means of a decanter, and then filtered under reduced pressure thereby to yield a filtered cake.

The thus obtained filtered cake was dried and measured of a solid content. The extractable TOC amount relative to 1 g of the toner (dry) was calculated in the same manner in Alkali Washing (1). It was found that the extracted TOC amount was 90 ppm/g.

The result is shown in Table 6.

—Water Washing (3)—

The thus obtained filtered cake by the alkali washing (2) was added with 300 parts of dionized water at 12,000 rpm for 10 minutes using TK Homo Mixer, and then filtered. This procedure was repeated until the conductivity of the dionized water after washing became 17 μS/cm to thereby yield a final filtered cake.

The thus obtained filtered cake was dried at 40° C. for 48 hours in a circulating air dryer. Thereafter, the dried cake was screened through a mesh of 75 μm opening, to thereby yield toner-base particles of Example 1.

—External-Additive Mixing—

To 100 parts of the previously obtained toner-base particles of Example 1 were added and mixed, as external additives, 0.7 parts of hydrophobic silica and 0.3 parts of hydrophobic titanium oxide as external additives using HENSCHEL MIXER (manufactured by Mitsui Mining Co.), to thereby yield a toner of Example 1.

Examples 2-7

The toner-base particles of Examples 2-7 were obtained in the same manner as in Example 1, provided that conditions for the washing were changed as shown in Table 1. Note that, the alkali washing, water washing, acid washing and water washing were performed, and thus the alkali washing was performed only once in Examples 3-4, and 6-7.

The thus obtained filtered cake was dried and measured of the solid content. The TOC amount relative to 1 g of the toner (dry) was calculated in the same manner in Example 1.

The results are shown in Table 6.

The thus obtained toner-base particles of Examples 2-7 were subjected to the external additive mixing in the same manner as in Example 1 to thereby yield toners of Examples 2-7.

TABLE 3

| | alkali washing 1 | | | water washing 1 | acid washing 1 | | | water washing 2 | alkali washing 2 | | | water washing 3 |
|---|---|---|---|---|---|---|---|---|---|---|---|---|
| Ex. | pH (–) | tem. (° C.) | time (h) | conductivity (μS/cm) | pH (–) | tem. (° C.) | time (h) | conductivity (μS/cm) | ph (–) | tem. (° C.) | time (h) | conductivity (μS/cm) |
| 1 | 10.5 | 25 | 2 | 20.0 | 3.0 | 25 | 0.5 | 10.0 | 7.0 | 25 | 1 | 17.0 |
| 2 | 7.0 | 50 | 6 | 18.3 | 3.0 | 25 | 2 | 9.8 | 7.0 | 50 | 6 | 15.2 |
| 3 | 10.5 | 25 | 1 | 12.5 | 4.5 | 25 | 1 | 9.3 | — | — | — | — |
| 4 | 7.0 | 25 | 50 | 18.3 | 3.0 | 25 | 2 | 4.5 | — | — | — | — |
| 5 | 10.3 | 50 | 5 | 14.0 | 3.8 | 30 | 0.5 | 6.5 | 10.3 | 50 | 6 | 6.4 |
| 6 | 6.2 | 40 | 10 | 35.0 | 3.3 | 40 | 1 | 17.8 | — | — | — | — |
| 7 | 7.8 | 15 | 35 | 51.2 | 1.3 | 15 | 30 | 48.2 | — | — | — | — |

Example 8

Formation of Toner Particles

The oil phase mixture was prepared in the same manner as in Example 1, provided that to the oil phase mixture was added 200 parts by mass of Crystalline Polyester Dispersion 1 of Production Example 1, and Dispersion slurry 2 was obtained from the oil phase mixture.

<Washing>

The toner-base particles of Example 8 were prepared in the same manner of Example 1, provided that the conditions for washing Dispersion Slurry 2 were changed as presented in Table 5.

The extractable TOC amount relative to 1 g of the toner (dry) after alkali-washing was measured in the same manner as in Example 1.

The results were shown in Table 6.

—External Additive Mixing—

The thus obtained toner-base particles of Example 8 were mixed with the external additive in the same manner as in Example 1, to thereby yield a toner of Example 8.

Examples 9-13

Formation of Toner Particles

The oil phase mixture was prepared in the same manner as in Example 1, provided that to the oil phase mixture was added 200 parts by mass of Crystalline Polyester Dispersion 3-7, respectively, and Dispersion slurry 3-7 were respectively obtained from the oil phase mixtures.

The combinations of Crystalline Polyester Dispersion and Dispersion Slurry in the oil phase mixture are shown in Table 4.

TABLE 4

| Ex. | Crystalline Polyester Dispersion | Dispersion Slurry | Tg of Toner (° C.) |
|---|---|---|---|
| 1 | — | 1 | 43 |
| 8 | Production Example 1 | 2 | 47 |
| 9 | Production Example 2 | 3 | 50 |
| 10 | Production Example 3 | 4 | 43 |
| 11 | Production Example 4 | 5 | 41 |
| 12 | Production Example 5 | 6 | 41 |
| 13 | Production Example 6 | 7 | 35 |

<Washing>

The toner-base particles of Examples 9-13 were prepared in the same manner of Example 1, provided that the conditions for washing were changed as presented in Table 5.

The extractable TOC amount relative to 1 g of the toner (dry) after the alkali-washing was measured in the same manner as in Example 1.

The results were shown in Table 6.

—External Additive Mixing—

The thus obtained toner-base particles of Examples 9-13 were mixed with the external additive in the same manner as in Example 1, to thereby yield a toner of Examples 9-13.

Example 14

Dispersion slurry was prepared in the same manner as in Example 1, provided that the particle dispersion was replaced with a particle dispersion prepared in the following manner. The thus obtained dispersion slurry was subjected to washing at the conditions presented in Table 5, to thereby yield toner-base particles. To the toner-base particles, external additive mixing was performed in the same manner as in Example 1, to thereby yield a toner.

—Preparation of Particle Dispersion—

Into a reactor equipped with a stirring rod and a thermometer were poured 683 parts of water, 11 parts of sodium salt of sulfuric acid ester of ethylene oxide adduct of methacrylic acid (Eleminol RS-30 manufactured by Sanyo Chemical Industries Co.), 80 parts of styrene, 83 parts of methacrylic acid, 110 parts of butyl acrylate, 12 parts of butyl thioglycolate and 1 part of ammonium persulfate, and the mixture was then stirred at 400 rpm for 15 minutes to thereby yield a white emulsion. The emulsion was heated to 75° C. and was allowed to react for 5 hours. The reaction mixture was further treated with 30 parts of a 1% aqueous solution of ammonium persulfate, was aged at 75° C. for 5 hours, to thereby yield an aqueous dispersion (particle dispersion) of vinyl resin particles (a copolymer of styrene-methacrylic acid-butyl acrylate-sodium salt of sulfate of methacrylic acid-ethylene oxide adduct). The dispersed particles in the thus obtained particle dispersion had a volume-average particle diameter of 120 nm by the laser scattering particle size distribution analyzer (LA-920 manufactured by Horiba, Ltd.). A part of the particle dispersion was dried to isolate the resin component. The resin component had a glass transition temperature (Tg) of 42° C. and a mass-average molecular mass (Mw) of 30,000.

Example 15

A toner was yielded in the same manner as in Example 3, provided that the conditions of the alkali washing were changed as presented in Table 5. The extractable TOC amount relative to 1 g of the toner (dry) after the alkali-washing was measured in the same manner as in Example 1.

The results are shown in Table 6.

Comparative Example 1

The toner was obtained in the same manner as in Example 3, provided that the conditions for washing were changed as presented in Table 1 such that the acid washing was performed after the alkali washing without performing the water washing therebetween. The extractable TOC amount relative to 1 g of the toner (dry) the after-washing was measured in the same manner as in Example 1.

The results are shown in Table 6.

Comparative Example 2

A toner was obtained in the same manner as in Example 3, provided that the conditions for washing were changed as presented in Table 5. The extractable TOC amount relative to 1 g of the toner (dry) after the alkali-washing was measured in the same manner as in Example 1.

The results are shown in Table 6.

Comparative Example 3

A toner was obtained in the same manner as in Example 3, provided that the conditions for washing were changed as presented in Table 5. The extractable TOC amount relative to 1 g of the toner (dry) after the alkali-washing was measured in the same manner as in Example 1.

The results are shown in Table 6.

TABLE 5

| | alkali washing 1 | | | water washing 1 | acid washing 1 | | | water washing 2 | alkali washing 2 | | | water washing 3 |
|---|---|---|---|---|---|---|---|---|---|---|---|---|
| Ex. | pH (–) | tem. (° C.) | time (h) | conductivity (μS/cm) | pH (–) | tem. (° C.) | time (h) | conductivity (μS/cm) | ph (–) | tem. (° C.) | time (h) | conductivity (μS/cm) |
| 8 | 7.9 | 50 | 1 | 14.2 | 3.5 | 50 | 0.5 | 4.5 | 7.8 | 50 | 1 | 13.5 |
| 9 | 7.8 | 60 | 1 | 13.5 | 3.6 | 60 | 0.5 | 7.5 | 7.8 | 60 | 1 | 12.5 |
| 10 | 7.9 | 50 | 1 | 8.5 | 3.4 | 50 | 0.5 | 4.6 | 7.9 | 50 | 1 | 11.5 |
| 11 | 7.8 | 40 | 1 | 15.0 | 3.5 | 40 | 0.5 | 5.3 | 7.4 | 40 | 1 | 14.3 |
| 12 | 7.6 | 31 | 1 | 16.2 | 3.5 | 41 | 0.5 | 7.2 | 6.3 | 31 | 1 | 14.4 |
| 13 | 7.7 | 25 | 1 | 17.5 | 3.6 | 25 | 0.5 | 6.7 | 10.8 | 25 | 1 | 13.7 |
| 14 | 7.2 | 25 | 1 | 6.5 | 2.7 | 25 | 0.5 | 4.2 | 8.2 | 26 | 1 | 4.7 |
| 15 | 12.0 | 25 | 1 | 35.0 | 4.5 | 25 | 1 | 21.0 | — | — | — | — |
| Com. 1 | 10.5 | 25 | 1 | — | 4.5 | 25 | 1 | 125.0 | — | — | — | — |
| Com. 2 | 6.1 | 25 | 0.5 | 55.0 | 4.5 | 25 | 1 | 40.0 | — | — | — | — |
| Com. 3 | 4.5 | — | — | 250.0 | 4.5 | 25 | 1 | 220.0 | — | — | — | — |

TABLE 6

| Ex. | alkali washing 1 TOC amount | alkali washing 2 TOC amount |
|---|---|---|
| 1 | 180 | 90 |
| 2 | 170 | 75 |
| 3 | 145 | — |
| 4 | 180 | — |
| 5 | 155 | 60 |
| 6 | 140 | — |
| 7 | 185 | — |
| 8 | 180 | 75 |
| 9 | 175 | 80 |
| 10 | 170 | 65 |
| 11 | 180 | 90 |
| 12 | 175 | 85 |
| 13 | 185 | 55 |
| 14 | 155 | 60 |
| 15 | 125 | — |
| Com. 1 | 290 | — |
| Com. 2 | 220 | — |
| Com. 3 | 450 | — |

5% of the external additive mixed toner of Examples 1-15 and Comparative Examples 1-3 and 95% of Cu—Zn ferrite carrier having silicone resin coating and an average particle size of 40 μm were mixed in the conventional method to thereby yield a developer of Examples 1-15 and Comparative Examples 1-3.

The thus obtained toner was subjected to the measurements of (a) toner particle size, (b) charging ability, and (c) fixing properties (offset occurring temperature and lowest fixing temperature) in a manner as described below. The results are shown in Table 7.

(a) Toner Particle Size

The volume average particle diameter (Dv) and number average particle diameter (Dn) of the toner were measured by means of a particle size analyzer (MultiSizer II, manufactured by Beckmann Coulter Inc.) with an aperture of 100 μm. The particle size distribution (Dv/Dn) of the toner was calculated therefrom.

(b) Charging Ability 7 parts by mass of each of toner obtained in Examples 1-15 and Comparative Examples 1-3 were mixed with 100 parts by mass of Cu—Zn ferrite carrier having silicone resin coating and an average particle size of 40 μm. The obtained sample was left in high temperature and high humidity (HH) environment (30° C., 90% RH), and in medium temperature and medium humidity (MM) environment (25° C., 50% RH), for 24 hours. Thereafter, the sample was loaded in a sealable metal cylinder, stirred at 280 rpm for 10 minuets and then subjected to a blow to thereby measure a charging amount.

(c) Fixing Properties (Offset-Occurring Temperature and Lowest Fixing Temperature)

The fixing properties (offset occurring temperature and lowest fixing temperature) were evaluated by using a tandem color electrophotographic device (Imagio Neo 450, manufactured by Ricoh Company, Ltd.), transfer sheets of plain paper (Type 6200, manufactured by Ricoh Company, Ltd.) and thick paper (Copy and Print Paper 135, manufactured by NBC Ricoh Co., Ltd.). Note that, the tandem color electrophotographic apparatus is capable of continuously printing sheets of A4 size at 45 pieces per minute.

<Offset Occurring Temperature>

An image was formed on the plain paper by means of the tandem color electrophotographic device. The device was adjusted so that 1.0±0.1 mg/cm2 of toner would develop a solid image in each of yellow, magenta, cyan, and black, as well as intermediate colors of red, blue, and green. The thus obtained toner image was fixed onto the sheet by varying the temperature of the fixing belt (heating roller). In this way, the lowest fixing temperature at which offset occurred was determined as offset occurring temperature.

<Lowest Fixing Temperature>

A copying test was carried out by using the thick paper, and the tandem color electrophotographic device.

The lowest fixing temperature was determined as a temperature of the fixing roller at which the obtained image maintained an image density of 70% or more after being rubbed by a pat.

TABLE 7

| | Toner particle size | | | charging amount | | fixing properties | |
|---|---|---|---|---|---|---|---|
| | | | | | | lowest fixing temperature | offset occuring temperature |
| Example | Dv(μm) | Dn(μm) | Dv/Dn | NN | HH | (° C.) | (° C.) |
| 1 | 5.1 | 4.5 | 1.13 | 25.2 | 20.1 | 145 | 200 or more |
| 2 | 5.0 | 4.5 | 1.11 | 24.8 | 19.6 | 145 | 200 or more |
| 3 | 5.0 | 4.6 | 1.09 | 21.1 | 16.9 | 145 | 200 or more |
| 4 | 5.1 | 4.6 | 1.11 | 22.5 | 17.2 | 145 | 200 or more |
| 5 | 5.0 | 4.5 | 1.11 | 24.2 | 20.2 | 145 | 200 or more |
| 6 | 5.1 | 4.5 | 1.13 | 20.1 | 18.1 | 145 | 200 or more |
| 7 | 5.0 | 4.6 | 1.09 | 21 | 15.3 | 145 | 200 or more |
| 8 | 5.8 | 5.3 | 1.09 | 23.5 | 18.5 | 130 | 200 or more |
| 9 | 5.6 | 5.1 | 1.1 | 25.1 | 19.4 | 130 | 200 or more |
| 10 | 4.9 | 4.4 | 1.11 | 24.6 | 17.7 | 130 | 200 or more |
| 11 | 5.3 | 4.9 | 1.09 | 23.6 | 18.5 | 125 | 200 or more |
| 12 | 5.2 | 4.6 | 1.12 | 21.7 | 17.8 | 120 | 200 or more |
| 13 | 5.7 | 5.2 | 1.1 | 19.6 | 14.4 | 120 | 200 or more |
| 14 | 5.1 | 4.6 | 1.11 | 23.9 | 18.9 | 140 | 200 or more |
| 15 | 7.5 | 5.2 | 1.44 | 18.5 | 17.2 | 140 | 200 or more |
| Com. 1 | 5.0 | 4.6 | 1.09 | 16.5 | 6.5 | 150 | 190 |
| Com. 2 | 5.0 | 4.6 | 1.09 | 20.5 | 10.1 | 150 | 195 |
| Com. 3 | 5.0 | 4.6 | 1.09 | 8.3 | 5.1 | 150 | 190 |

The results in Table 7 show that Examples 1-15 obtained a toner which has an excellent charging ability even when being left under high temperature high humidity for a long period of time, and thus has desirable shelf stability. Moreover, it was found that Examples 1-15 obtained a toner which excels in hot-offset resistance and low-temperature fixing properties.

Note that, since alkaline of the alkali washing conditions was enhanced in Example 15, the alkalinity became excessive, the polyester of the toner was eroded, and hence the toner particle size was adversely affected thereby.

The dried and external-additive added toners obtained in Examples 1-15 and Comparative Examples 1-3 were subjected to evaluations of an extractable amount of TOC relative to 1 g of the toner (dry) and charge-rising ability in the following manner. The results are shown in Table 8 and FIG. 5.

<Extractable Amount of Total Organic Carbon (TOC)>

A TOC amount extracted from the toner was measured by means of TOC analyzer, TOC-5000A, manufactured by Shimadzu Corporation. 7.5 g of each of the alkali-washed toners was precisely weighted in a 140 ml bottle (S1). To the bottle was added 47.5 g of KOH aqueous solution of pH 9 (S2). Ultrasonic was imparted to the mixture at 30° C. or lower for 30 minutes, and about 1.5 ml of the mixture was subjected to centrifugal separation in a microtube. The supernatant of the separated mixture was filtered by 0.2 μm microfilter so as to remove fine particles, and the rest of the supernatant was poured back to the microtube. The filter was washed by tap-water and then by pure water, and then the depositions of the separated mixture were filtered by 1 μm microfilter. To the obtained filtrate were added two drops of HCl (35% by mass) aqueous solution, and pH of the mixed solution was confirmed to be 3 or less. The obtained mixed solution was precisely weighted (T1), and added and diluted with pure water so that the total weight to be 6.0 mg. Thereafter, the diluted solution precisely weighted (T2). The thus obtained solution is heated at 680° C. so as to generate the carbon in the organic substances in the solution as carbonic acid gas, and the extracted TOC amount was measured by analyzing the carbonic acid gas by infrared spectroscopy. The TOC amount can be calculated by the following equation.

$$\text{TOC (ppm/g)} = \text{TOC measurement} \times (S1+S2)/\{S1 \times (\text{Solid content (mass \%)}/100)\} \times T2/T1) \quad \text{<Equation>}$$

<Charge-Rising Ability>

6 g of each of developers were sampled. The obtained sample was loaded in a sealable metal cylinder, stirred at 280 rpm for 15 seconds and then subjected to a blow to thereby measure a charging amount. Note that, the larger negative charging amount is superior the charge-rising ability is. When the charge amount is −20 μC/g or negatively larger, the toner is quickly charged as soon as it is supplied within the photocopier, and hence is capable of forming high quality images.

TABLE 8

| Example | released TOC amound (ppm/g) | charging amount (μC/g) |
|---|---|---|
| 1 | 75 | −25 |
| 2 | 165 | −15 |
| 3 | 130 | −23 |
| 4 | 180 | −20 |
| 5 | 55 | −38 |
| 6 | 130 | −21 |
| 7 | 195 | −18 |
| 8 | 65 | −35 |

TABLE 8-continued

| Example | released TOC amound (ppm/g) | charging amount (μC/g) |
|---|---|---|
| 9 | 80 | −28 |
| 10 | 55 | −31 |
| 11 | 75 | −27 |
| 12 | 80 | −28 |
| 13 | 45 | −40 |
| 14 | 55 | −35 |
| 15 | 120 | −15 |
| Com. 1 | 280 | −3 |
| Com. 2 | 220 | −5 |
| Com. 3 | 460 | 8 |

As evidenced by the results in Table 8 and FIG. 8, it was found that the released TOC amount and charge-rising speed were closely related to each other. In Examples of 1-15, the dried and external additive added toner releases a small amount of TOC, and thus has an excellent charge-rising ability. In Comparative Examples 1-3, on the other hand, the toner leases a large amount of TOC, and thus has an inferior charge-rising ability.

What is claimed is:

1. A toner obtainable by a process which comprises granulating an intermediate toner comprising a polyester having a terminal carboxyl group, and subjecting the granulated toner to at least washing with a neutral washing solution and at least one alkali washing solution wherein a total organic carbon (TOC) amount extractable from the final alkali-washed toner is 100 ppm/g or less and TOC neutral amount <TOC alkali amount, and wherein alkali washing is carried out such that the pH of the washing solution after washing is 6.0 to 11.0, and at a temperature such that the toner does not melt or particles thereof do not attach to each other, and for a time period such that the polyester does not induce a hydrolysis reaction.

2. The toner according to claim 1, wherein the intermediate toner is formed by the process comprising:

allowing an active hydrogen group-containing compound and a polymer capable of reacting with an active hydrogen group-containing compound to react in an aqueous medium so as to form particles containing an adhesive-base material.

3. The toner according to claim 1, further comprising a crystalline polyester.

4. The toner according to claim 3, wherein the crystalline polyester has a DSC endothermic peak temperature of 50° C. to 150° C.

5. The toner according to claim 1, further comprising resin particles.

6. The toner according to claim 5, wherein the resin particles are formed of at least one resin selected from a vinyl resin, a polyurethane resin, an epoxy resin, and a polyester resin.

7. The toner according to claim 1, wherein the polyester has an acid value of 5 mg KOH/g to 50 mg KOH/g.

* * * * *